US007420133B2

(12) United States Patent
Farrow et al.

(10) Patent No.: US 7,420,133 B2
(45) Date of Patent: Sep. 2, 2008

(54) DOOR INTERLOCK FOR ROTARY ACTUATED CIRCUIT BREAKER

(75) Inventors: John Foster Farrow, Plymouth, MI (US); Jeffrey J. Mason, Elgin, IL (US)

(73) Assignee: Welding Technology COrporation, Carol Stream, IL (US)

( * ) Notice: Subject to any disclaimer, the term of this patent is extended or adjusted under 35 U.S.C. 154(b) by 0 days.

(21) Appl. No.: 11/844,150

(22) Filed: Aug. 23, 2007

(65) Prior Publication Data

US 2008/0053797 A1 Mar. 6, 2008

Related U.S. Application Data

(60) Provisional application No. 60/840,858, filed on Aug. 29, 2006.

(51) Int. Cl.
*H01H 9/20* (2006.01)

(52) U.S. Cl. ..... 200/50.15; 200/50.12; 200/50.13

(58) Field of Classification Search ... 200/50.01–50.04, 200/50.12–50.17, 50.21, 50.23, 50.24, 318, 200/321–326, 333, 334
See application file for complete search history.

(56) References Cited

U.S. PATENT DOCUMENTS

| | | | | |
|---|---|---|---|---|
| 2,954,444 A | | 9/1960 | Jones et al. | |
| 3,122,615 A | | 2/1964 | Chace | |
| 3,192,334 A | * | 6/1965 | Dimond et al. | 200/50.12 |
| 3,299,233 A | | 1/1967 | Sciba | |
| 3,313,896 A | * | 4/1967 | Gray | 200/50.13 |
| 3,970,808 A | * | 7/1976 | Gryctko et al. | 200/50.15 |
| 3,980,845 A | * | 9/1976 | Gryctko et al. | 200/50.15 |
| 4,074,091 A | * | 2/1978 | Bischof et al. | 200/50.15 |
| 4,405,844 A | * | 9/1983 | Dizon et al. | 200/50.12 |
| 4,835,350 A | * | 5/1989 | Ozu et al. | 200/50.12 |
| 4,926,286 A | * | 5/1990 | Maki et al. | 361/617 |
| 5,493,083 A | | 2/1996 | Olivier | |
| 5,493,084 A | | 2/1996 | Whitaker | |
| 5,963,420 A | * | 10/1999 | Bailey et al. | 361/616 |

* cited by examiner

*Primary Examiner*—Michael A Friedhofer
(74) *Attorney, Agent, or Firm*—Reinhart Boerner Van Deuren S.C.

(57) ABSTRACT

A rotary circuit breaker door safety interlock for use with a power switch actuated by a rotating shaft installed in a enclosure with a hinged door is disclosed. The door safety rotary circuit breaker interlock functions both to prevent the enclosure door from being opened unless the power switch has first been turned OFF, and to prevent the power switch from being turned ON while the enclosure door is open. The door safety rotary circuit breaker interlock can be intentionally overridden to allow the enclosure door to be opened without turning the power switch OFF, and to allow the power switch to be turned ON while the enclosure door is open. The door safety rotary circuit breaker interlock is simple mechanically, requires no springs or deformable members for its operation, and can be adapted to many mounting variations in enclosures having doors that hinge at the left, right, top, or bottom.

20 Claims, 15 Drawing Sheets

DOOR INTERLOCK FOR ROTARY ACTUATED CIRCUIT BREAKER

CROSS-REFERENCE TO RELATED APPLICATION

This application claims priority of U.S. Provisional Patent Application No. 60/840,858, which is entitled "Door Interlock for Rotary Actuated Power Switch," and which was filed on Aug. 29, 2006, the entirety of which application is hereby incorporated herein by reference.

BACKGROUND OF THE INVENTION

Field of the Invention

The present invention relates generally to mechanical door safety interlocks for use with circuit breakers, and more particularly to a simple, mechanical rotary circuit breaker door safety interlock for installation and use in an enclosure having a hinged door to operate a rotary circuit breaker that is actuated by rotation of a shaft that is operated by a handle located on and accessible from the outside of the enclosure with the hinged door closed.

For safety reasons, high-power electrical or electronic devices which contain voltages lethal to people are housed in enclosures that have locking doors. The enclosures are either made from electrically insulating, fireproof material, or they are made of metal and are electrically connected to earth (or safety) ground with large conductors so that if anything inside the enclosure breaks, arcs, explodes, or otherwise malfunctions, the lethal voltage is contained within the enclosure. The enclosure prevents any significant voltage from escaping to the exterior of the enclosure, irrespective of what occurs inside the enclosure.

In such enclosures that contain high-power electrical or electronic devices and/or switchgear, there is often a circuit breaker (which is in essence a disconnect switch) that is placed in series with the incoming electrical power line. This circuit breaker is coupled to a handle that is located on the outside of the enclosure, which handle may be manipulated to operate the circuit breaker located inside the enclosure to turn the electrical power in the enclosure on or off. To protect people from the hazardous voltage that is present inside the enclosure, the circuit breaker is often mechanically interlocked with the enclosure door so that the door cannot be opened when the handle is in the on position.

This mechanical interlocking function is typically performed by an interlock mechanism that is mechanically linked to a circuit breaker that is mounted inside the enclosure. One common type of circuit breaker is a rotary circuit breaker that is actuated by a rotating shaft operated by a handle located on the outside of the enclosure (typically on a bracket that is accessible through an opening located in the door of the enclosure). The handle is rotated between ON and OFF positions to operate the rotary circuit breaker. Rotation of the handle from the OFF position to the ON position actuates the interlock mechanism to cause it to lock the enclosure door closed, and rotation of the handle from the ON position to the OFF position allows the enclosure door to open. The interlock switch should also prevents the power switch from moving from the OFF position to the ON position while the enclosure door is open.

A number of interlock mechanisms have been proposed to date, one of which is illustrated for purposes of example in U.S. Pat. No. 4,835,350, to Ozu et al. This mechanism shown in the Ozu et al. patent represents an improvement over earlier such devices inasmuch as the Ozu et al. mechanism is simpler and has fewer parts. However, the Ozu et al. mechanism still uses two pivoting members and a spring to push the pivoting members into position to engage an interlocking arm. Also, should the spring used by the Ozu et al. mechanism wear out or break, the Ozu et al. mechanism would be rendered ineffective.

SUMMARY OF THE INVENTION

The present invention is a mechanical door safety interlock device for use with a rotary circuit breaker that is installed in a enclosure with a hinged door. The door safety rotary circuit breaker interlock of the present invention functions to prevent the enclosure door from being opened unless the rotary circuit breaker has been actuated to turn the power off in the enclosure. It also prevents the rotary circuit breaker from being actuated to turn the power on in the enclosure power when the enclosure door is open. As such, the door safety rotary circuit breaker interlock has safety as its primary goal, ensuring that power coming into the enclosure via the rotary circuit breaker is off whenever the enclosure door is open, thereby exposing electrical components contained in the enclosure which are connected to hazardous voltages only when the enclosure door is closed and the rotary circuit breaker is subsequently placed in the on position.

The door safety rotary circuit breaker interlock of the present invention is designed for use with a rotary circuit breaker that is driven between off and on positions with a rotating mechanism. The rotating mechanism on the rotary circuit breaker is coupled to an actuating handle that is located on and accessible from the outside of the enclosure via a rotating actuation shaft. This shaft typically has a square cross-section, with both the portion of the rotary circuit breaker and the portion of the handle that respectively engage the shaft having a matching square configuration.

The door safety rotary circuit breaker interlock of the present invention includes four essential components: a mounting bracket, a tongue bracket, a latch plate, and a door hook. The mounting bracket is mounted to the enclosure, and has a front plate that is typically received by an aperture in the enclosure door such that the outer surface of the front plate of the mounting bracket is both visible and accessible from outside the enclosure when the enclosure door is closed. The handle, which is typically packaged with the rotary circuit breaker, is mounted on the outer surface of the front plate of the mounting bracket, with the mounting bracket being mounted to the enclosure. The actuation shaft is located between and engaged with both the handle mounted on the mounting bracket in the enclosure and the rotary circuit breaker, which is also mounted in the enclosure.

The tongue bracket is mounted onto the actuation shaft, and includes a tongue that is supported in parallel to and spaced away from the actuation shaft such that the tongue will rotate as the actuation shaft is rotated by the handle. The latch plate is mounted on the back side of the front plate of the mounting bracket for rotation about the mounting point of the latch plate on the front plate. The latch plate has a notch located therein which engages the tongue of the tongue bracket. The latch plate is mounted onto the front plate of the mounting bracket so that gravity will cause the latch plate to move such that the notch in the latch plate moves toward the actuation shaft so that it can engage the tongue of the tongue plate when the shaft is in a certain position.

The door hook is mounted on the back side of the door in a position where it can be selectively engaged by the distal end of the latch plate. When the handle is in the OFF position and the enclosure door is open, the tongue of the tongue bracket is engaged by the notch in the latch plate and the handle cannot be rotated to the ON position. The latch plate is moved to this position by gravity. When the enclosure door is closed, the door hook moves the latch plate (against the force of gravity) to a position in which the notch in the latch plate no longer engages the tongue of the tongue bracket, thereby allowing the handle to be rotated to the ON position.

When the handle is moved from its ON position to its OFF position, the tongue of the tongue bracket is placed in a position to engage the notch in the latch plate. In this exemplary embodiment, the handle must be rotated approximately five degrees past the OFF position in order for the tongue of the tongue bracket to drive the latch plate to a position in which the latch plate no longer engages the door hook, allowing the enclosure door to be opened. In another embodiment, the door can be opened when the handle is in the OFF position. Optionally, the movement of the latch plate by gravity can also be assisted through the addition of a spring.

It may be appreciated that the door safety rotary circuit breaker interlock of the present invention represents both a simplification to and an improvement upon other interlock devices that have been known in the past. Aside from the handle and the actuation shaft which are used to turn the rotary circuit breaker on and off and the door hook mounted on the back side of the enclosure door, the door safety rotary circuit breaker interlock of the present invention has only one moving part, namely the latch plate. No complex linkages or springs are either used or required for the door safety rotary circuit breaker interlock to operate, since gravity provides all the force that is necessary to move the latch plate from its unlocked position to its locked position.

DESCRIPTION OF THE DRAWINGS

These and other advantages of the present invention are best understood with reference to the drawings, in which.

DETAILED DESCRIPTION OF EXEMPLARY EMBODIMENTS

It will be appreciated by those skilled in the art that the door safety rotary circuit breaker interlock of the present invention is intended for use with a rotary circuit breaker (not shown in FIGS. 1 through 8) that is mounted in an enclosure having a hinged enclosure door (not shown in FIGS. 1 through 8). Such a rotary circuit breaker is available with a door-mounted handle for installation in an enclosure having a mounting bracket that is visible through an aperture contained in a hinged enclosure door. The rotary circuit breaker is mounted in the enclosure, the handle is mounted on the mounting bracket, and an actuation shaft operatively connects the handle to the rotary circuit breaker. Such enclosures may be, for example, approximately 0.8 meters wide by 1.2 meters high by 0.3 meters deep.

Figure 1:
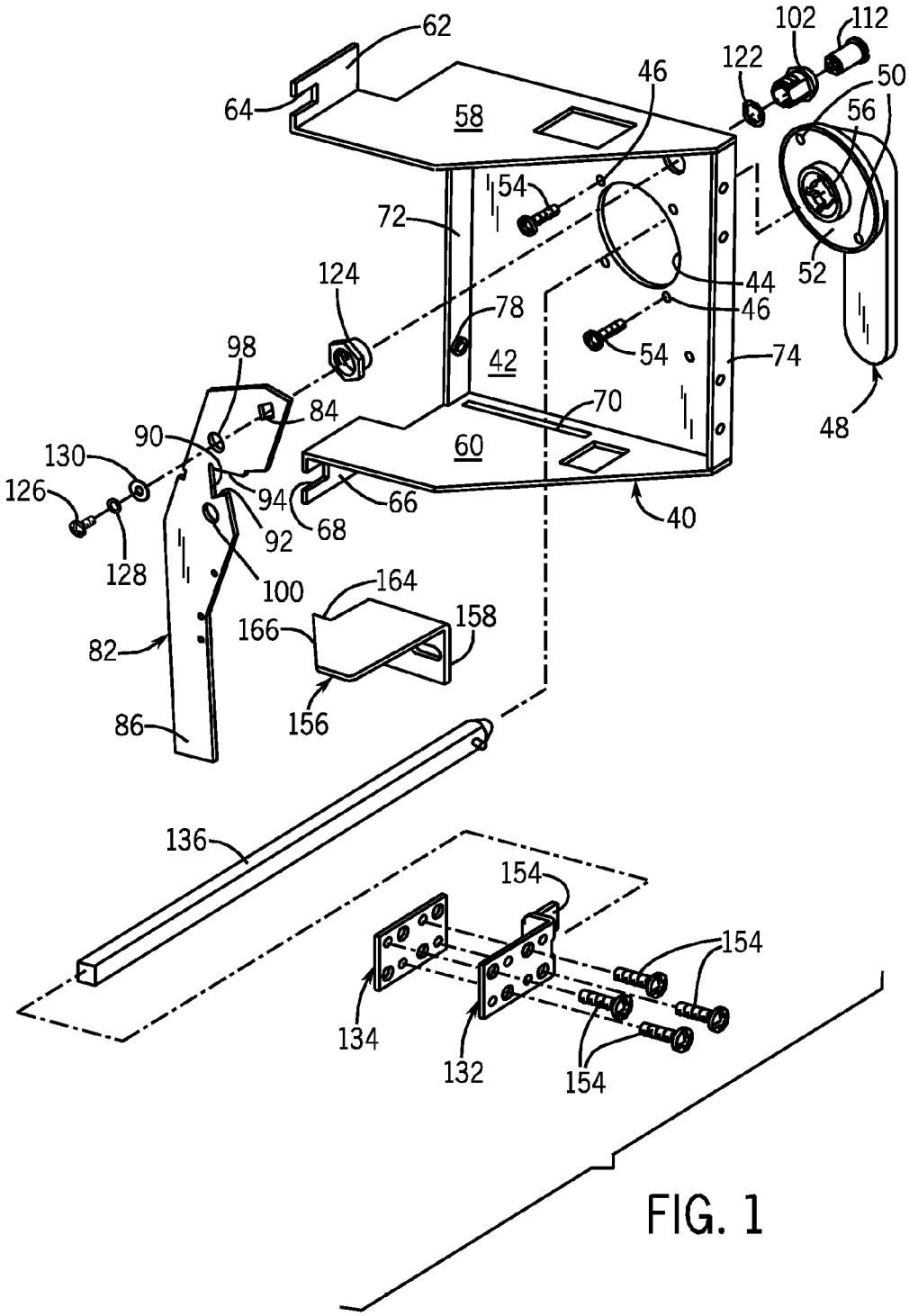
FIG. 1 is an exploded view of the components of a first exemplary embodiment of the door safety rotary circuit breaker interlock of the present invention for use with an enclosure having an enclosure door hinged on the right side.

An exemplary embodiment of the door safety rotary circuit breaker interlock of the present invention is illustrated in FIGS. 1 through 15. These and the remaining figures and the description contained in this specification should be interpreted as illustrating the inventive concepts of the invention through the use of a few specific examples. The reader will understand that many other variations of the invention are possible within the same inventive concepts. Reference will be made initially to FIG. 1, which shown an exploded view of the components of the door safety rotary circuit breaker interlock, and to FIGS. 2 through 8, which show detailed depictions of the various components shown in the exploded view of FIG. 1.

Figures 2, 3:
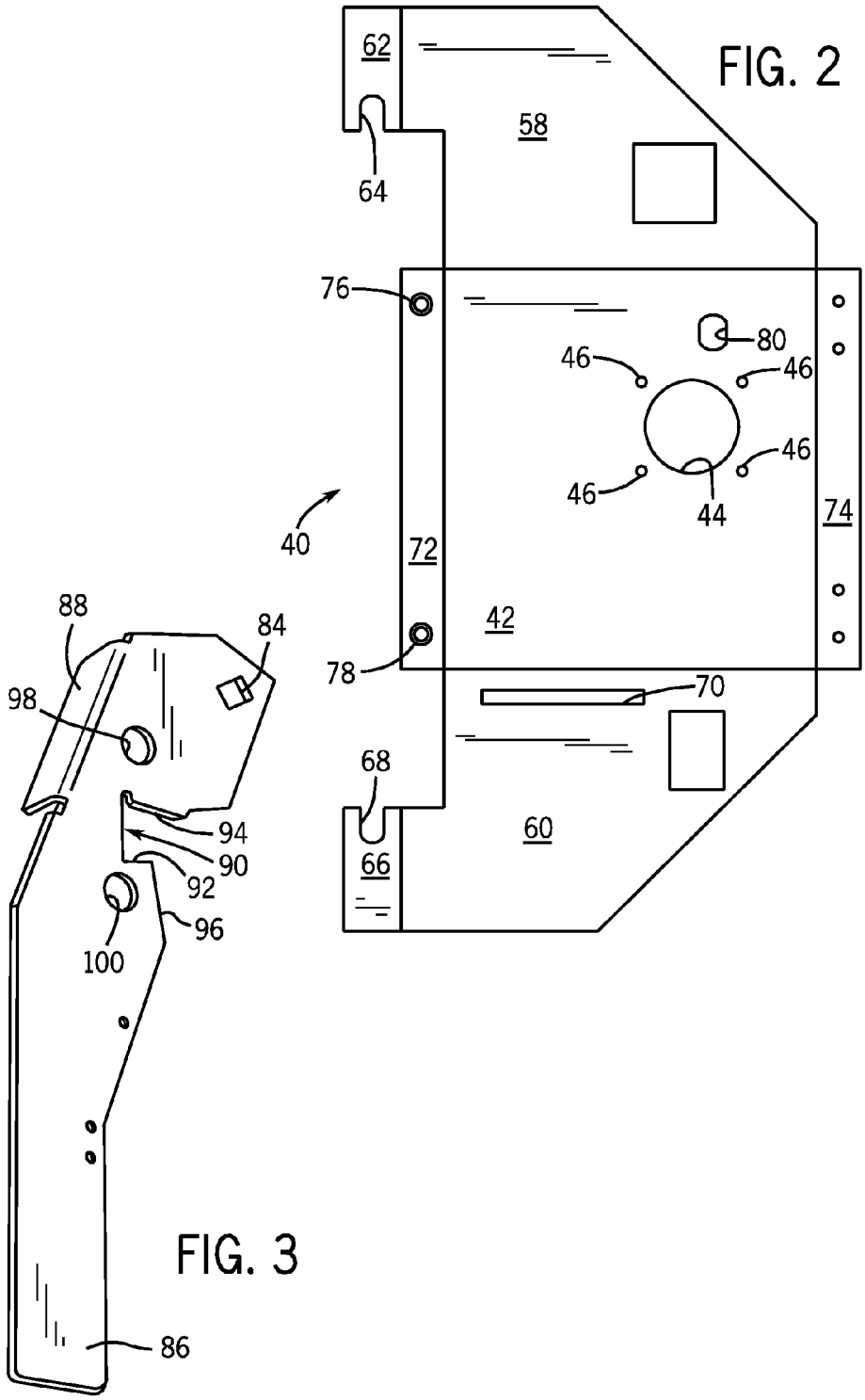
FIG. 2 is a plan view showing the layout of the mounting bracket shown in FIG. 1 in unfolded form.
FIG. 3 is an isometric view of the latch plate shown in FIG. 1.
Figure 4:
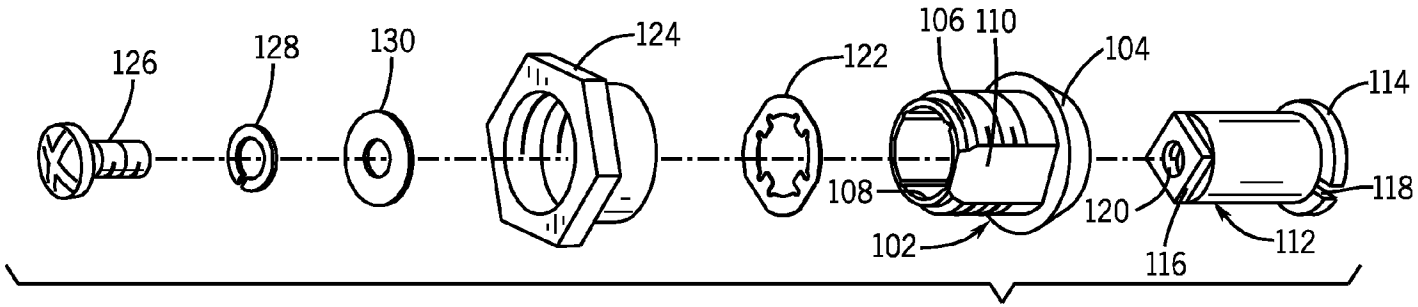
FIG. 4 is an enlarged exploded view of the latch plate mounting hardware shown in FIG. 1.
Figure 5:
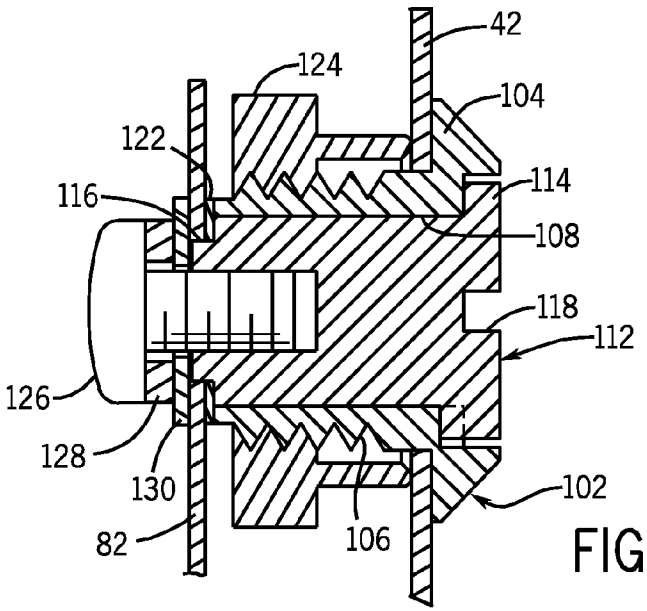
FIG. 5 is a cross-sectional view of the latch plate mounting hardware shown in FIGS. 1 and 4.

Referring first to FIGS. 1 and 2, the first of four major components of the door safety rotary circuit breaker interlock of the present invention is a mounting bracket 40, upon which the other components illustrated in FIG. 4 are mounted. The mounting bracket 40 is typically made of steel sheet metal, and will be rigidly mounted in an enclosure (not illustrated in FIGS. 1 through 8) and has a rectangular front plate 42 that will be received in a rectangular aperture located on an enclosure door that is hingedly mounted on the enclosure (also not shown in FIGS. 1 through 8) when the enclosure door is closed on the enclosure. The mounting bracket 40 will completely cover the aperture located on an enclosure door when the enclosure door is closed on the enclosure, and may contact the rear of the enclosure door when the enclosure door is closed. Gasketing may be installed between the mounting bracket 40 and the door to prevent water and dust ingress. The mechanism of the door safety rotary circuit breaker interlock is located behind the mounting bracket 40. The mounting bracket 40 shown in FIG. 1 is for mounting on the right side of an enclosure (as viewed from the front side of the enclosure, which is the side accessible through an enclosure door.

Located in the rectangular front plate 42 of the mounting bracket 40 is a large aperture 44 surrounded by four smaller apertures 46. The aperture 44 and the apertures 46 are for mounting a handle 48 on the front side of the rectangular front plate 42. The back side of the handle 48 has two threaded apertures 50 located on a base 52 of the handle 48 on opposite sides thereof to facilitate mounting of the handle 48.

Two bolts 54 extend through two of the apertures 46 in the rectangular front plate 42 and are screwed into the threaded apertures 50 in the base 52 of the handle 48 to mount the handle 48 onto the rectangular front plate 42. The handle 48 has a square aperture 56 accessible from the back side thereof that is rotatably driven by rotation of the handle 48 on the base 52. It will be appreciated by those skilled in the art that the handle 48 rotates with respect to the base 52 to drive the square aperture 56.

The mounting bracket 40 has a rearwardly-extending top plate 58 and a rearwardly-extending bottom plate 60. Located on the right side of the top plate 58 (as the mounting bracket 40 would be viewed from the front side thereof) near the rear side thereof is a mounting flange 62 having a rearwardly-opening (as viewed from the front side of the mounting bracket 40) slot 64 located therein. Located on the right side of the bottom plate 60 (as the mounting bracket 40 would be viewed from the front side thereof) near the rear side thereof is a mounting flange 66 having a rearwardly-opening (as viewed from the front side of the mounting bracket 40) slot 68 located therein. The slots 64 and 68 will receive mounting hardware such as bolts (not shown in FIGS. 1 through 8) to mount the mounting bracket 40 to the right side of an enclosure (not shown in FIGS. 1 through 8).

Located in the bottom plate 60 in a position that is near to but spaced slightly from the rectangular front plate 42 is a slot 70 through which an operative component of the door safety rotary circuit breaker interlock of the present invention will extend. The slot 70 is located nearer to the side of the bottom plate 60 on which the mounting flange 66 is mounted than it is to the opposite side of the bottom plate 60.

The right and left sides of the rectangular front plate 42 (as viewed from the front side of the mounting bracket 40) have rearwardly-extending flanges 72 and 74, respectively. The flange 72 two threaded inserts 76 and 78 mounted therein near the top and the bottom thereof, respectively. The threaded inserts 76 and 78 may be used together with the slots 64 and 68 to facilitate mounting the mounting bracket 40 into an enclosure (not shown in FIGS. 1 through 8).

A flat-sided aperture 80 is located in the rectangular front plate 42 above the aperture 44, with the centerline of the flat-sided aperture 80 being somewhat to the left 42 of the centerline of the aperture 44 (as viewed from the front side of the mounting bracket 40). The configuration of the flat-sided aperture 80 is circular with flat sides. The flat-sided aperture 80 will be used to receive mounting hardware shown in FIGS. 1 and 6, which will be discussed in detail below.

Referring next to FIGS. 1 and 3, a latch plate 82 which is the second of the four major components of the door safety rotary circuit breaker interlock of the present invention is shown. The latch plate 82 is made of a flat piece of steel or another durable metal or material and has an extended length. The latch plate 82 will be pivotally mounted on the back side of the rectangular front plate 42 of the mounting bracket 40. It has a square hole 84 located near its top right as shown in FIGS. 1 and 3, which square hole 84 will be used to pivotally mount the latch plate 82 onto the mounting bracket 40.

The latch plate has a distal end indicated generally by the reference numeral 86, which distal end 86 will extend downwardly through the slot 70 in the bottom plate 60 of the mounting bracket 40. It is the lateral movement of this distal end 86 that will be used to latch the enclosure door closed, as will become apparent below. The latch plate 82 has flange 88 located on an intermediate portion of the left side of the latch plate 82 and extending toward the direction faced by the back side of the latch plate 82 as it is shown in FIGS. 1 and 3. This flange 88 is used to support the latch plate 82 in a position which is spaced away from the rear side of the rectangular front plate 42 of the mounting bracket 40 when the latch plate 82 is pivotally mounted in the mounting bracket 40.

The latch plate 82 has a notch 90 located in the right side of the latch plate 82 as it is shown in FIGS. 1 and 3. The notch 90 is located nearer the top than the bottom of the latch plate 82 as it is shown in FIGS. 1 and 3. The notch 90 has a bottom lip 92 that is located at the bottom thereof and a top lip 94 that is located at the top thereof as the latch plate 82 is shown in FIGS. 1 and 3. Extending downwardly and rightwardly from the bottom lip 92 on the right side of the latch plate 82 as it is shown in FIGS. 1 and 3 is an approach lip 96. Two access apertures 98 and 100 are respectively located above and below the notch 90 in the latch plate 82.

Figure 6:
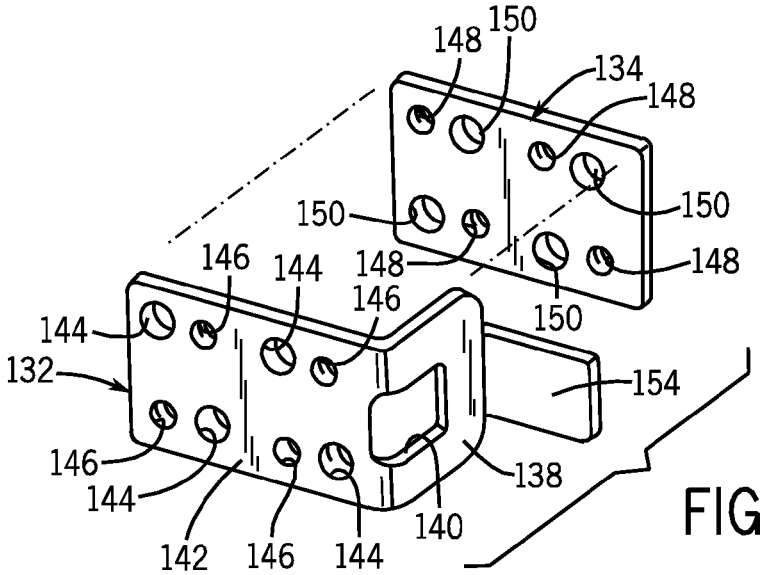
FIG. 6 is an isometric view of the tongue bracket and the tongue bracket mounting plate shown in FIG. 1.
Figure 7:
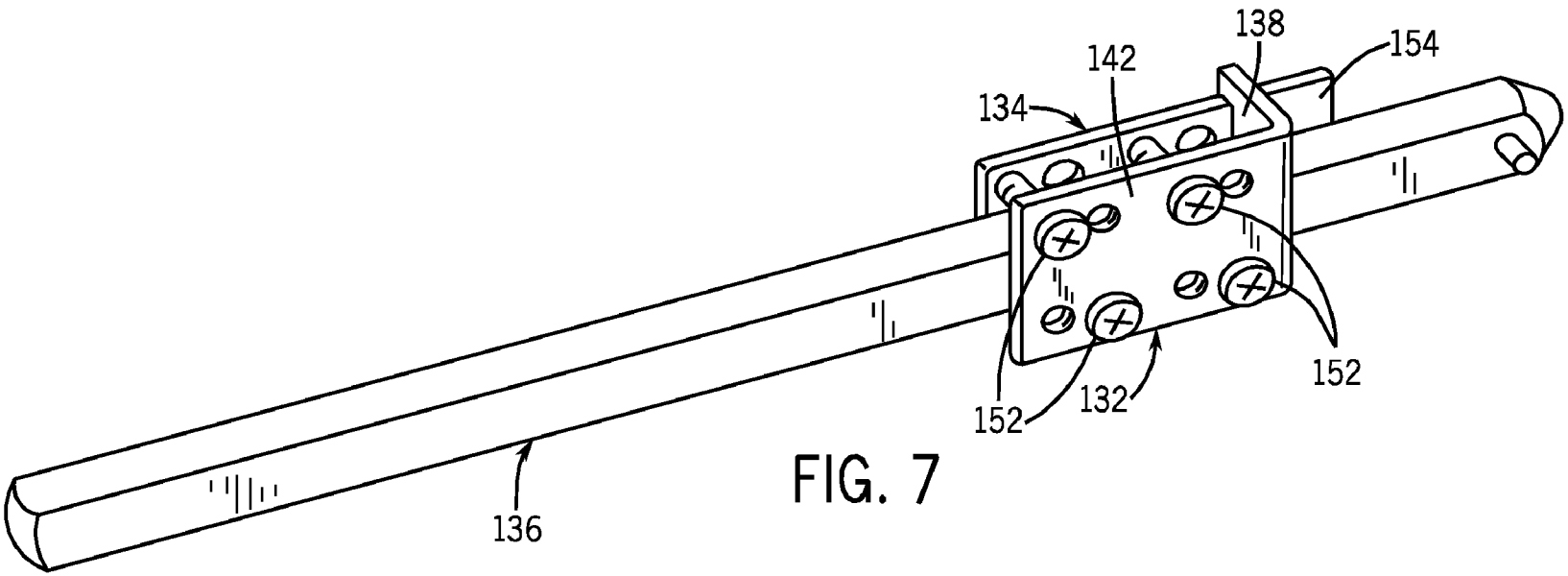
FIG. 7 is an isometric view of the tongue bracket and the tongue bracket mounting plate shown in FIGS. 1 and 6 mounted on the actuation shaft shown in FIG. 1.

Referring next to FIGS. 1, 6, and 7 the mounting hardware that is used to pivotally mount the latch plate 82 on the mounting bracket 40 is shown. A sleeve 102 having an outwardly extending annular flange 104 at one end thereof and a threaded portion 106 located at the opposite end thereof is effectively the housing of the mounting hardware. The sleeve 102 has an aperture 108 extending longitudinally therethrough, and its outer surface has flat faces 110 on both sides thereof to enable the sleeve 102 to fit into the flat-sided aperture 80 in an irrotatable manner.

A rotatable member 112 has a cylindrical outer configuration that is sized to fit the aperture 108 in the sleeve 102 in a rotatable fashion. The rotatable member 112 has an outwardly extending annular flange 114 located at one end thereof and a square extension 116 located at the opposite end thereof. The surface of the end of the rotatable member 112 having the flange 114 thereupon has a slot 118 located therein to permit it to be driven by a flat-bladed screwdriver or the like. The end of the rotatable member 112 having the square extension 116 thereupon has a threaded aperture 120 located therein.

That end of the rotatable member 112 is inserted into the end of the sleeve 102 having the annular flange 104 thereupon, and the square extension 116 extends fully out of the end of the sleeve 102 having the threaded portion 106 thereupon. A retaining ring 122 is interference-fit onto the square extension 116 to retain the rotatable member 112 in the sleeve 102. The outer diameter of the retaining ring 122 is larger than the inner diameter of the aperture 108, but smaller than the outer diameter of the threaded portion 106 of the sleeve 102.

The assembly consisting of the sleeve 102, the rotatable member 112, and the retaining ring 122 is inserted into the flat-sided aperture 80 in the rectangular front plate 42 of the mounting bracket 40 with the annular flange 104 of the sleeve 102 located on the front side of the rectangular front plate 42 and the threaded portion 106 of the sleeve 102 extending through the flat-sided aperture 80 to the back side of the rectangular front plate 42. A shoulder nut 124 is then screwed onto the threaded portion 106 of the sleeve 102, retaining the sleeve 102 in position in the rectangular front plate 42 of the mounting bracket 40.

The square hole 84 in the latch plate 82 is then placed onto the square extension 116 of the rotatable member 112, with the distal end 86 of the latch plate 82 extending through the slot 70 in the bottom plate 60 of the mounting bracket 40. A small bolt 126 is then inserted through a lock washer 128 and a flat washer 130, and then is screwed into the threaded aperture 120 in the rotatable member 112 to retain the latch plate 82 on the mounting hardware, thereby pivotally mounting the latch plate 82 on the mounting bracket 40. As mentioned above, when the latch plate 82 is so mounted, the flange 88 maintains its position in spaced-away fashion from the back side of the rectangular front plate 42 of the mounting bracket 40.

It will thus be appreciated by those skilled in the art that the latch plate 82 is mounted in the mounting bracket 40 for pivoting movement about the square hole 84 in the latch plate 82. The pivoting movement of the latch plate 82 is limited by the engagement of the distal end 86 of the latch plate 82 with the slot 70 in the bottom plate 60 of the mounting bracket 40. The location of the square hole 84 in the latch plate is well off-center, so when the door safety rotary circuit breaker interlock is mounted in the orientation shown in FIG. 1, gravity will urge the latch plate 82 downward in a counterclockwise rotation around the mounting point of the square hole 84 in the latch plate 82.

Referring next to FIGS. 1, 6, and 7, a tongue bracket 132 and a tongue bracket mounting plate 134 which together constitute the third of the four major components of the door safety rotary circuit breaker interlock of the present invention are shown. The tongue bracket 132 and the tongue bracket mounting plate 134 will be operatively mounted on an actuation shaft 136, which is a shaft typically having a square cross-section usually made of metal such as steel. The actuation shaft 136 is used to transmit the rotary motion of the handle 48 (shown in FIG. 1) to a rotary circuit breaker (not shown in FIGS. 1 through 8) that is mounted inside the enclosure (also not shown in FIGS. 1 through 8).

The tongue bracket 132 and the tongue bracket mounting plate 134 are made of flat pieces of steel or another durable metal or material. The tongue bracket 132 is L-shaped, with a ninety-degree bend located therein. The base 138 of the "L" of the tongue bracket 132 has a square aperture 140 located therein adjacent the leg 142 of the "L" that is sized to admit the actuation shaft 136. The tongue bracket 132 is shown mounted on the actuation shaft 136 in FIGS. 1 and 7, with the actuation shaft 136 extending through the square aperture 140 in the tongue bracket 132.

The tongue bracket mounting plate 134 is approximately the same size and configuration as the leg 142 of the "L" of the tongue bracket 132. The tongue bracket 132 has four apertures 144 located in the base 142 of the "L" of the tongue bracket 132 and four threaded apertures 146 located in the base 142 of the "L" of the tongue bracket 132 as well. The tongue bracket mounting plate 134 has four threaded apertures 148 located therein and four apertures 150 located therein as well.

When the tongue bracket mounting plate 134 is located immediately on the opposite side of the actuation shaft 136 from the tongue bracket 132 (as shown in FIGS. 1 and 7), the apertures 144 in the leg 142 of the "L" of the tongue bracket 132 are aligned with the threaded apertures 148 in the tongue bracket mounting plate 134. Additionally, the apertures 150 in the tongue bracket mounting plate 134 are aligned with the threaded apertures 146 in the leg 142 of the "L" of the tongue bracket 132. Four bolts 152 are inserted respectively through the four apertures 144 in the leg 142 of the "L" of the tongue bracket 132 and are respectively screwed into the threaded apertures 148 in the tongue bracket mounting plate 134. Alternately, or additionally, it will be appreciated that four bolts (not shown) could be inserted respectively through the apertures 150 in the tongue bracket mounting plate 134 and respectively screwed into the threaded apertures 146 of the leg 142 of the "L" of the tongue bracket 132.

Located at the end of the base 138 of the "L" of the tongue bracket 132 that is distal to the leg 142 of the "L" of the tongue bracket 132 is a tongue 154 that extends from the base 138 of the "L" of the tongue bracket 132 in a direction opposite the direction that the leg 142 of the "L" of the tongue bracket 132 extends from the base 138 of the "L" of the tongue bracket 132. Thus, it will be appreciated that the tongue 154 extends in a direction parallel to and spaced away from the actuation shaft 136, and is located near the end of the actuation shaft 136 which will be driven by the square aperture 56 in the handle 48. The tongue 154 and the base 138 of the "L" of the tongue bracket 132 are preferably made of a single flat piece of steel or another durable metal or material.

When the door safety rotary circuit breaker interlock of the present invention is assembled and operating, the tongue 154 will engage with the notch 90 in the latch plate 82. It will be appreciated by those skilled in the art that the tongue 154 could be suspended from the actuation shaft 136 in a variety of different ways. For example, the tongue 154 could instead be a Z-shaped piece of metal that is rigidly attached to the shaft 136 by welding, clamping or other means suitable for a reliable connection.

Figure 8:
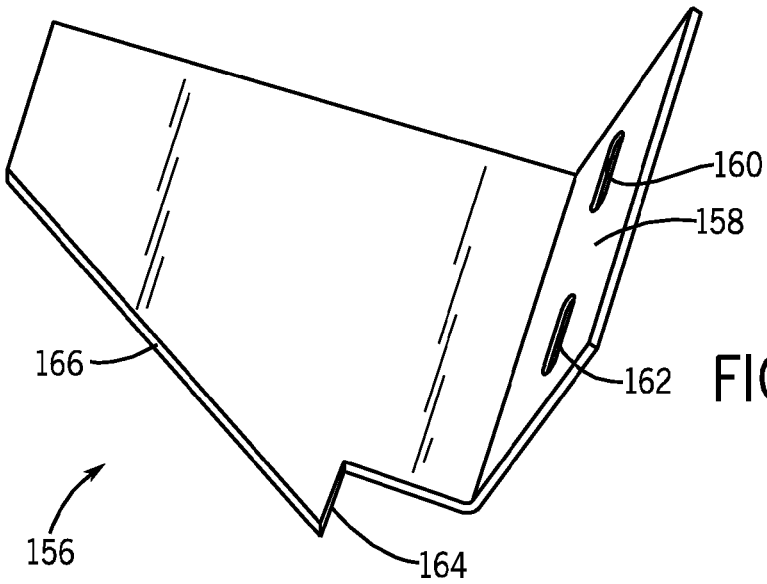
FIG. 8 is an isometric view of the door hook shown in FIG. 1.

Referring next to FIGS. 1 and 8, a door hook 156 which constitutes the fourth of the four major components of the door safety rotary circuit breaker interlock of the present invention is shown. The door hook 156 will be operatively mounted on an enclosure door (not shown in FIGS. 1 through 8), and will operatively and selectively be engaged by and disengaged from the distal end 86 of the latch plate 82. The door hook 156 is made of a flat piece of steel or another durable metal or material, with a flange 158 extending therefrom at a ninety degree angle.

The flange 158 has two slots 160 and 162 located therein, which slots 160 and 162 may be used to facilitate mounting the door hook 156 onto the back side of an enclosure door (not shown in FIGS. 1 through 8) at a location in the enclosure door just below the aperture in the enclosure door that will be aligned with the rectangular front plate 42 of the mounting bracket 40 when the enclosure door is in a closed position on the enclosure. The door hook 156 may be attached to the enclosure door either using bolts extending through the slots 160 and 162 in the flange 158, or by other suitable means such as welding.

The door hook 156 has a latching area 164 that extends orthogonally outwardly from the side of the door hook 156 at a location that is spaced slightly away from the flange 158. When the enclosure door is closed, the latching area 164 of the door hook 156 will engage the distal end 86 of the latch plate 82 to secure the enclosure door in a closed position on the enclosure. The end of the door hook 156 that is distal from the flange 158 has a tapered engagement area 166 that extends outwardly at an angle until it intersects with the latching area 164. The engagement area 166 will initially engage the distal end 86 of the latch plate 82 as the enclosure door is being closed, moving the distal end 86 of the latch plate 82 aside until the engagement area 166 passes the distal end 86 of the latch plate 82, whereupon the distal end 86 of the latch plate 82 will be engaged by the latching area 164.

Figure 9:
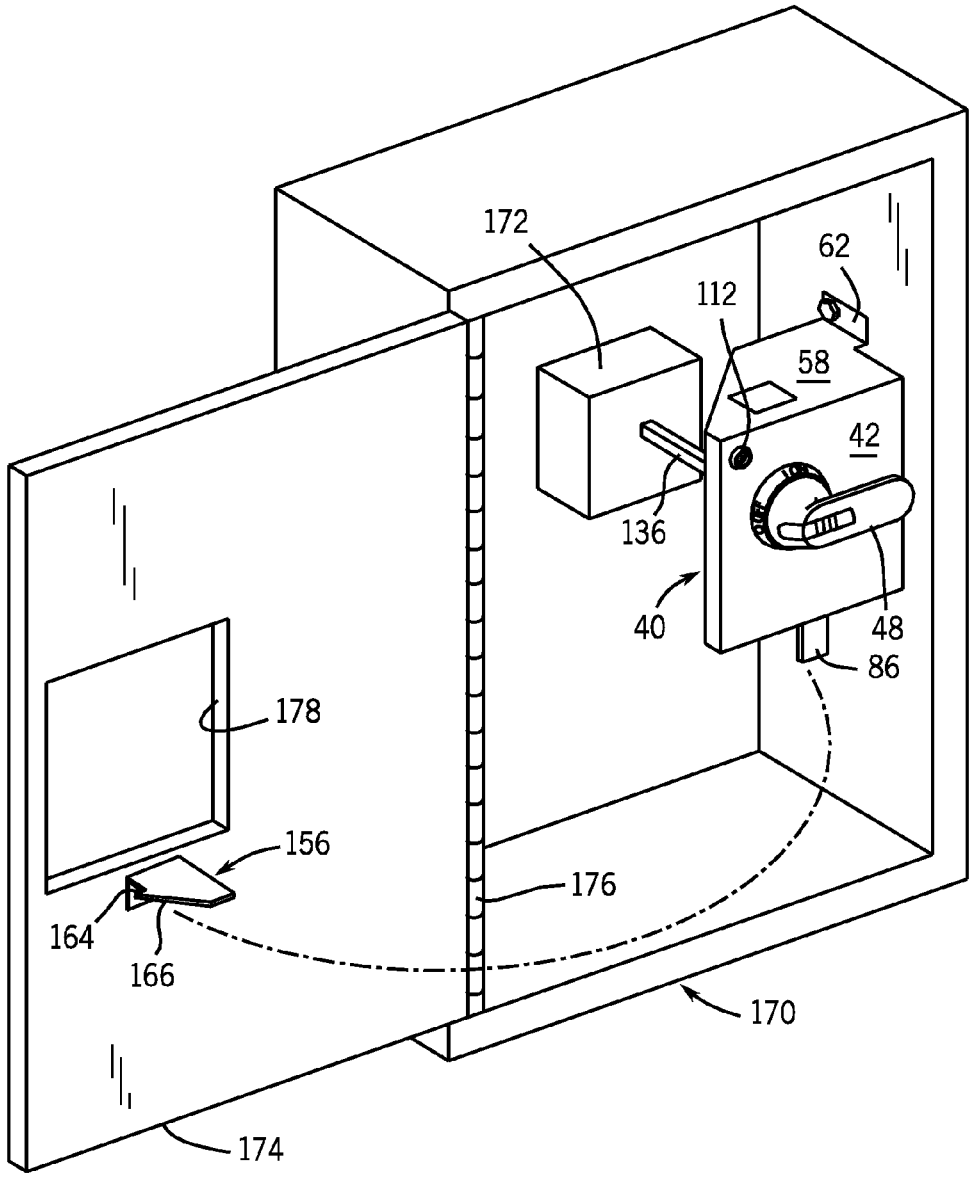
FIG. 9 is an isometric view showing the components shown in FIGS. 1 through 7 installed in an enclosure together with a rotary circuit breaker, and also showing the door hook shown in FIGS. 1 and 8 mounted on the back side of an enclosure door.

Referring next to FIG. 9, the door safety rotary circuit breaker interlock of the present invention as described in FIGS. 1 through 8 is shown installed in an enclosure 170 in a central position on the right side of the enclosure 170. Mounted in the back of the enclosure 170 behind the door safety rotary circuit breaker interlock is a rotary circuit breaker 172. The actuation shaft 136 has one end inserted into the square aperture 56 in the handle 48 (shown in FIG. 1) and the other end inserted into a square aperture (not shown herein) in the rotary circuit breaker 172. Thus, the handle 48 will be used to operate the rotary circuit breaker 172 via the actuation shaft 136.

Mounted on the enclosure 170 is an enclosure door 174, which is hinged on the left side of the enclosure 170 using a hinge 176. Centrally located on the side of the enclosure door 174 opposite the hinge 176 is a square aperture 178 that will receive the rectangular front plate 42 of the mounting bracket 40 therein when the enclosure door 174 is closed on the enclosure 170. The door hook 156 is mounted on the back side of the enclosure door 174 below the square aperture 178. The door hook 156 is positioned and oriented to engage the distal end 86 of the latch plate 82 when the enclosure door 174 on the enclosure 170. The details of the engagement of the door hook 156 with the distal end 86 of the latch plate 82 will be discussed below in conjunction with FIGS. 10 through 15.

The size of a typical enclosure 170 is approximately 0.8 meters wide, 1.2 meters high, and 0.3 meters deep. The door safety rotary circuit breaker interlock of the present invention is designed to lock the enclosure door 174 on the enclosure 170 when the enclosure door 174 is closed through the engagement of the door hook 156 with the distal end 86 of the latch plate 82.

Figure 10A:
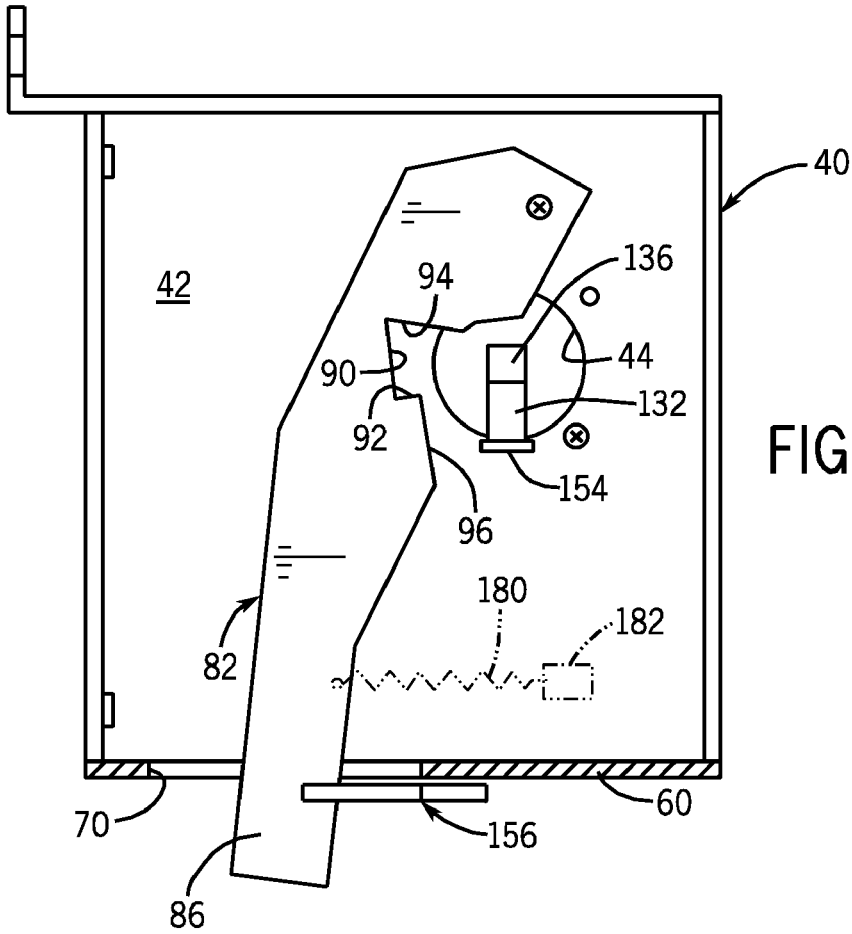
FIGS. 10A and 10B are rear cutaway and bottom plan views, respectively, of the installed door safety rotary circuit breaker interlock shown in FIG. 9, with the enclosure door closed and locked and the handle in the ON position.
Figure 10B:
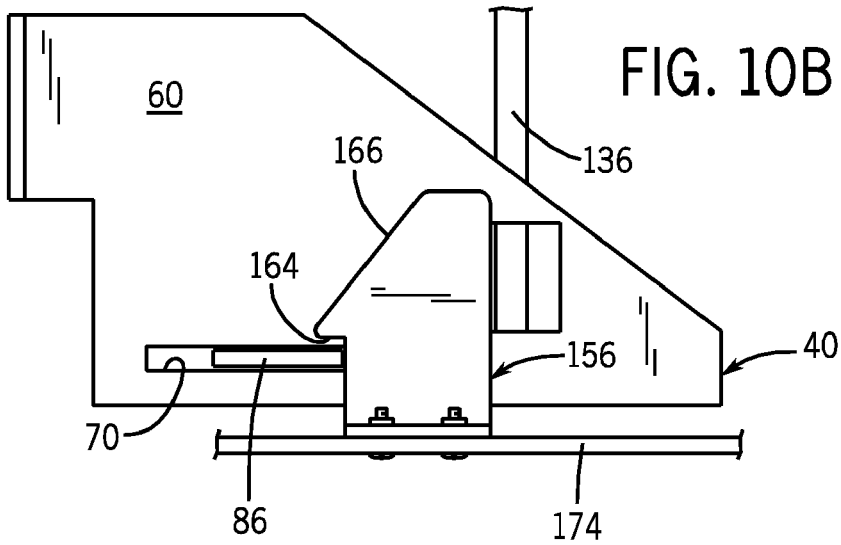

Referring next to FIGS. 10A and 10B in conjunction with FIG. 9, these figures show the door safety rotary circuit breaker interlock described above with reference to FIGS. 1 through 8 as viewed from inside the enclosure 170, looking toward the enclosure door 174, which is in a fully closed position, and with the handle 48 being in its ON position (which will cause the rotary circuit breaker 172 to supply electrical power to the enclosure 170). FIG. 10A shows the door safety rotary circuit breaker interlock from its rear side, and FIG. 10B shows it from its bottom side.

FIGS. 10A and 10B show the tongue bracket 132 and the tongue 154 schematically for purposes of simplifying these drawings, and a portion of the bottom plate 60 has been cut away to clearly show the slot 70 and the distal end 86 of the latch plate 82. The door hook 156 and a portion of the enclosure door 174 are shown in FIG. 10B, while only the upwardly-facing edges of the door hook 156 are shown in FIG. 10A. FIG. 10A is from the back side of the mounting bracket 40, and FIG. 10B is from the bottom of the mounting bracket 40. These conventions will all be followed in FIGS. 11 through 15 as well.

Referring then to FIGS. 10A and 10B, in which the handle 48 (shown in FIG. 9) is in its ON position, it may be seen that the tongue 154 is positioned directly below the actuation shaft 136 (as viewed in FIG. 10A). In this position, the tongue 154 does not engage any portion of the latch plate 82, including the notch 90. It will be appreciated that the force of gravity urges the latch plate 82 into the position in which it is shown in FIGS. 10A and 10B, with the distal end 86 of the latch plate 82 being urged into engagement with the door hook 156, behind the latching area 164 of the door hook 156. Thus, with the handle 48 in the ON position, the distal end 86 of the latch plate 82 engages the door hook 156 to secure the enclosure door 174 in its closed position.

It will be appreciated by those skilled in the art that the door safety rotary circuit breaker interlock of the present invention does not require a spring or any other biasing means, relying instead only on gravity). All of the force necessary to move the door safety rotary circuit breaker interlock to a locked configuration is provided by gravity acting upon the weight of the latch plate 82. This provides an extra measure of reliability, because there are no springs to break or fall out of the door safety rotary circuit breaker interlock into the enclosure 170. Also, the door safety rotary circuit breaker interlock cannot fail to operate as intended due to a broken or missing spring.

However, a spring 180 may optionally used as a redundant force to urge the latch plate 82 in a counterclockwise direction (as viewed in FIG. 10A). The spring 180 is shown in phantom lines in FIG. 10A as extending between a location on the right side of the latch plate 82 (as viewed in FIG. 10A) just above the distal end 86 and a bracket 182 mounted on the rectangular front plate 42 near its lower right corner (as viewed in FIG. 10A). Thus, both the force of gravity and the spring 180 urge the latch plate 82 in a counterclockwise direction (as viewed in FIG. 10A). Although a spring can be added, the entire mechanism requires no springs or flexible elements for its operation.

Figure 11A:
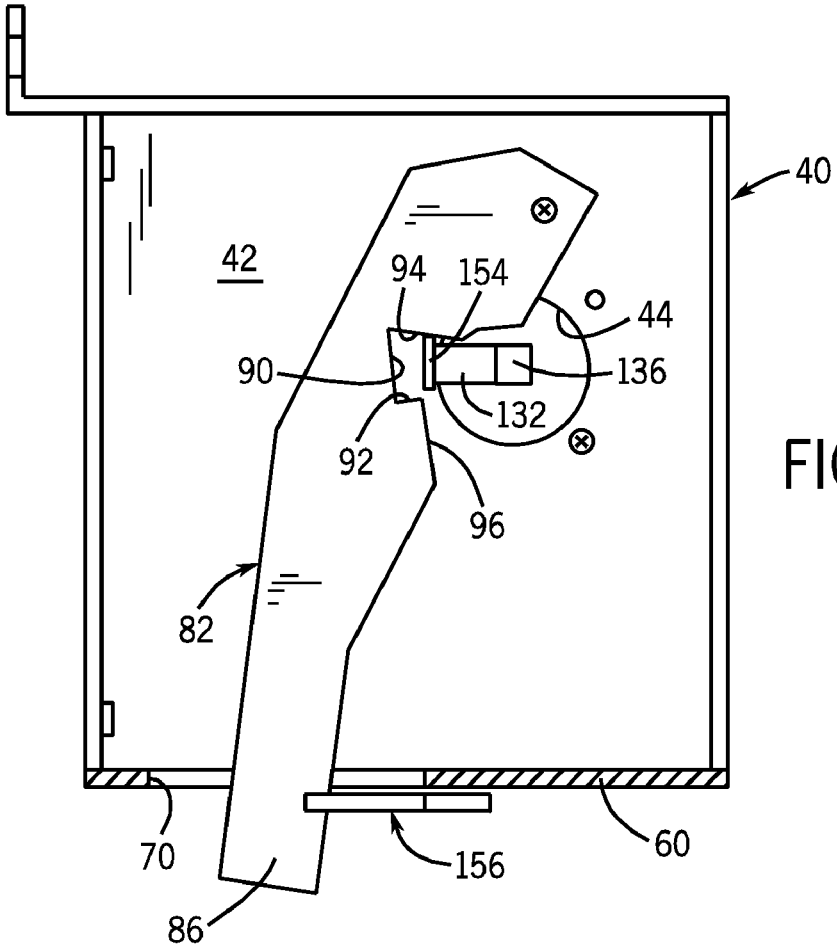
FIGS. 11A and 11B are rear cutaway and bottom plan views, respectively, of the installed door safety rotary circuit breaker interlock shown in FIG. 9, with the enclosure door closed and locked and the handle in the OFF position.
Figure 11B:
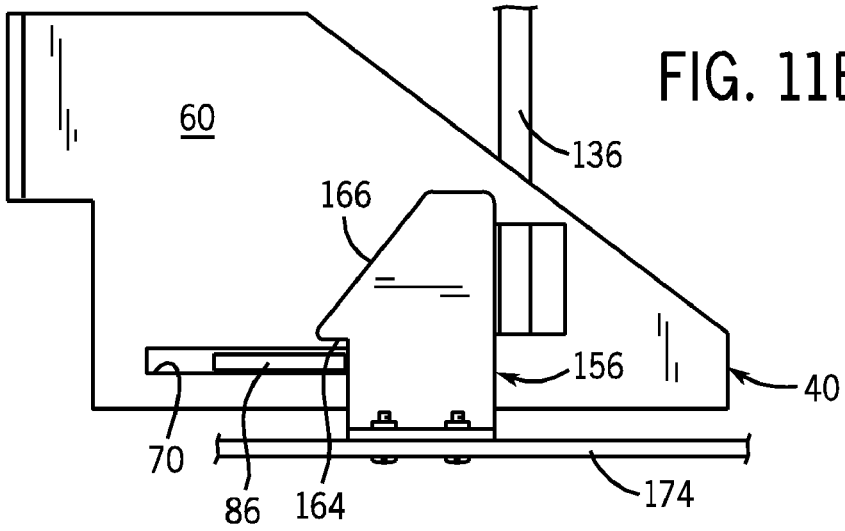

Referring next to FIGS. 11A and 11B, the handle 48 (shown in FIG. 9) has been turned ninety degrees counterclockwise (as viewed from the front of the enclosure the enclosure 170 in FIG. 9) to its OFF position, causing the actuation shaft 136 to rotate ninety degrees clockwise (as viewed in FIG. 11A) and the tongue 154 to be positioned directly to the left of the actuation shaft 136 (as viewed in FIG. 11A). In this position, the tongue 154 does not engage the notch the notch 90, but is oriented directly into the notch 90. Thus, the force of gravity still urges the latch plate 82 into the position in which it is shown in FIGS. 11A and 11B, with the distal end 86 of the latch plate 82 still being in engagement with the door hook 156, behind the latching area 164 of the door hook 156. Thus, with the handle 48 in the OFF position, the distal end 86 of the latch plate 82 still engages the door hook 156 to secure the enclosure door 174 in its closed position.

Figure 12A:
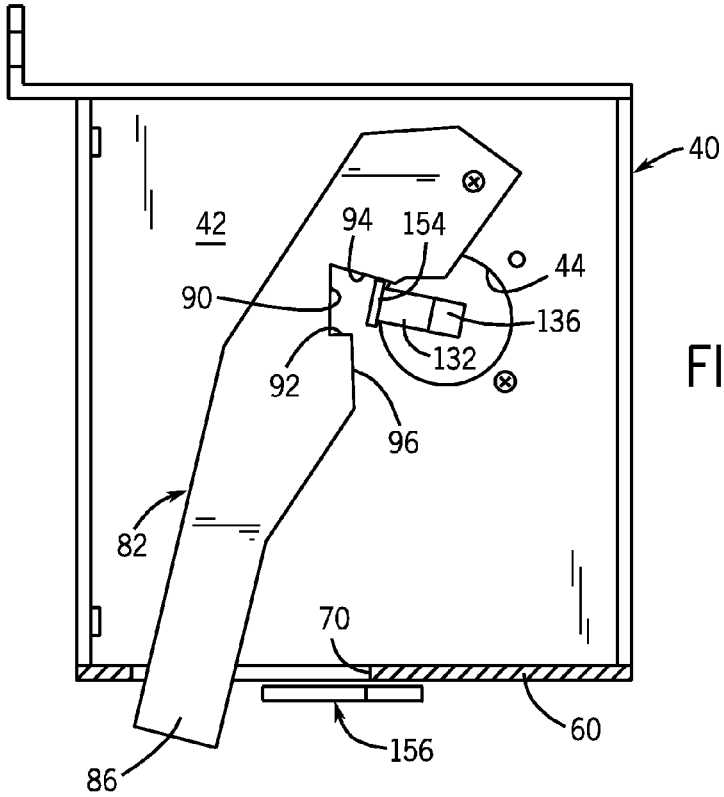
FIGS. 12A and 12B are rear cutaway and bottom plan views, respectively, of the installed door safety rotary circuit breaker interlock shown in FIG. 9, with the handle turned five degrees past the OFF position to unlock the enclosure door, which is still in the closed position.
Figure 12B:
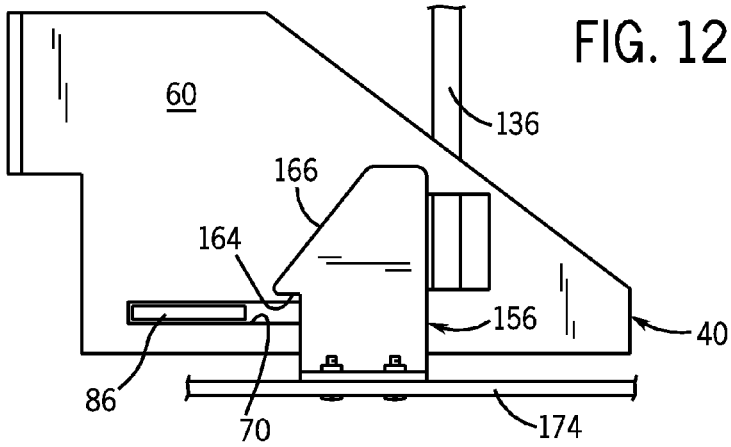

Referring now to FIGS. 12A and 12B, the handle 48 (shown in FIG. 9) has been turned five degrees further counterclockwise (as viewed from the front of the enclosure 170 in FIG. 9) beyond its OFF position, causing the actuation shaft 136 and the tongue 154 to rotate an additional five degrees clockwise (as viewed in FIG. 11A). It may be seen that the tongue 154 has driven the top lip 94 of the notch 90 of the latch plate 82 upwardly, causing the entire latch plate 82 to rotate clockwise (as viewed in FIG. 12A). This movement of the latch plate 82 moves the distal end 86 of the latch plate 82 out of engagement with the latching area 164 of the door hook 156, thereby disengaging the door hook 156 and allowing the enclosure 170 to be opened.

To overcome the weight of the latch plate 82 and the friction of the tongue 154 as it contacts the top lip 94 of the latch plate 82, it will be appreciated that some force is required. The requirement of this additional force to rotate the actuation shaft 136 the additional five degrees clockwise (as viewed in FIG. 11A) and the handle 48 the additional five degrees further counterclockwise (as viewed from the front of the enclosure 170 in FIG. 9) slightly past the OFF position ensures that the rotary circuit breaker 172 has been completely moved to its OFF position and that an intentional action is required to open the enclosure door 174, even when the power has been turned off In this way, the opening of the enclosure door 174 is absolutely mechanically interlocked to the power-off position of the actuation shaft 136.

Figure 13A:
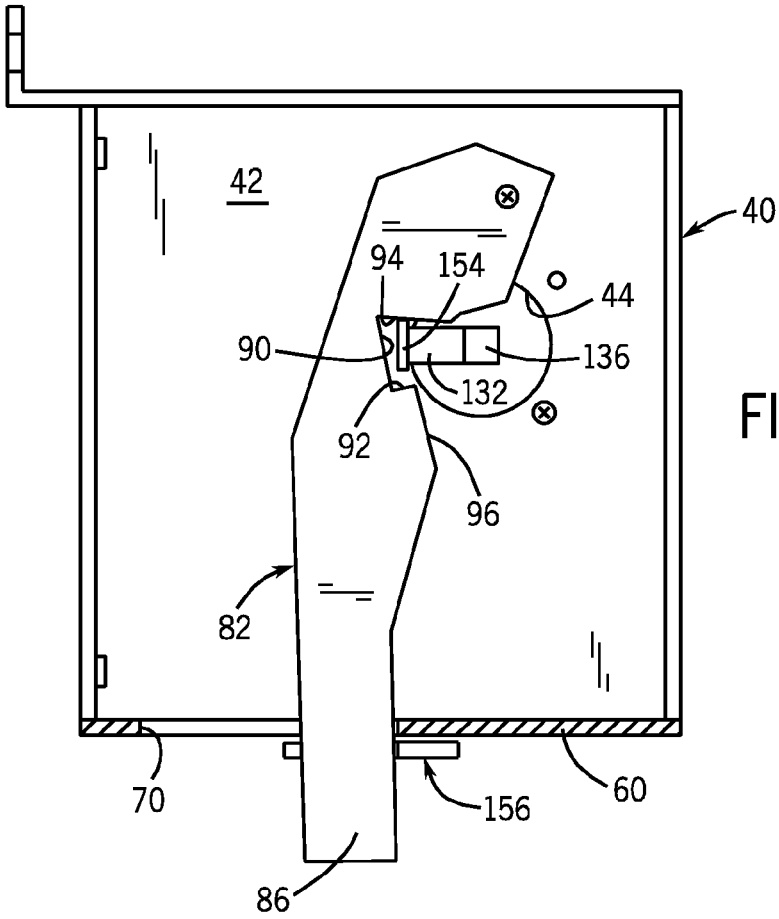
FIGS. 13A and 13B are rear cutaway and bottom plan views, respectively, of the installed door safety rotary circuit breaker interlock shown in FIG. 9, with the enclosure door open and the handle unable to move from the OFF position to the ON position.
Figure 13B:
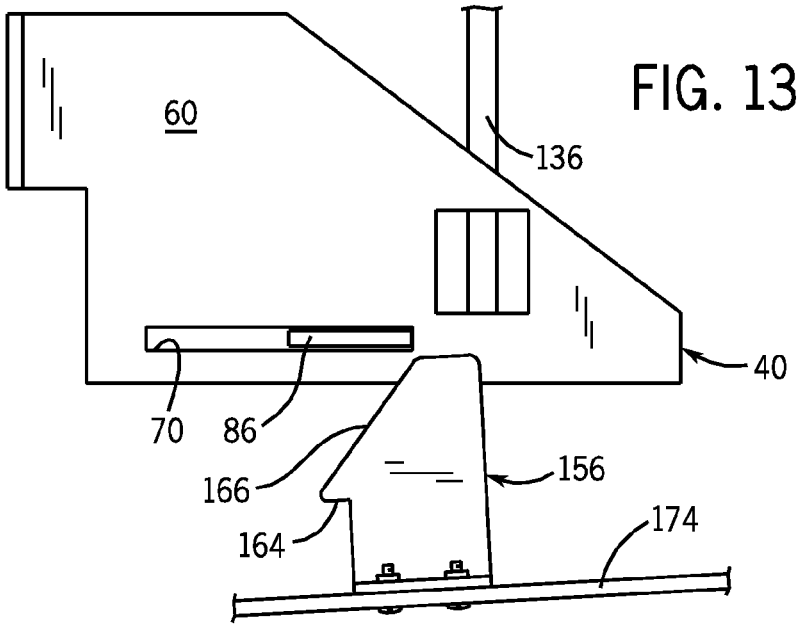

Referring next to FIGS. 13A and 13B, once the enclosure door 174 has been opened and force is removed from the handle 48 (shown in FIG. 9) (i.e., the person rotating the handle 48 releases it), the handle 48 will return to its OFF position by the force of gravity causing the latch plate 82 to rotate counterclockwise (as viewed in FIG. 13A) As this occurs, the top lip 94 of the latch plate 82 urges the tongue 154 downwardly to a position which is directly to the left of the actuation shaft 136 (as viewed in FIG. 13A). This will cause the actuation shaft 136 to rotate five degrees counterclockwise (as viewed in FIG. 11A) and the handle 48 to rotate five degrees clockwise (as viewed from the front of the enclosure 170 in FIG. 9) back to its OFF position, with the tongue 154 captured in the notch 90 of the latch plate 82. In this position, the tongue 154 engages the bottom lip 92 of the notch 90 in the latch plate 82, preventing the tongue bracket mounting plate 134 from rotating further in a counterclockwise direction (as viewed in FIG. 13A) and the handle 48 from being rotated from its OFF position to its ON position.

This is also the position that the latch plate 82, the actuation shaft 136, and the tongue 154 will be in as the enclosure 170 is beginning to be shut. In this position, the engagement area 166 of the door hook 156 is just about to contact the distal end 86 of the latch plate 82, which contact will cause the latch plate 82 to begin to be rotated clockwise (as viewed in FIG. 13A).

Figure 14A:
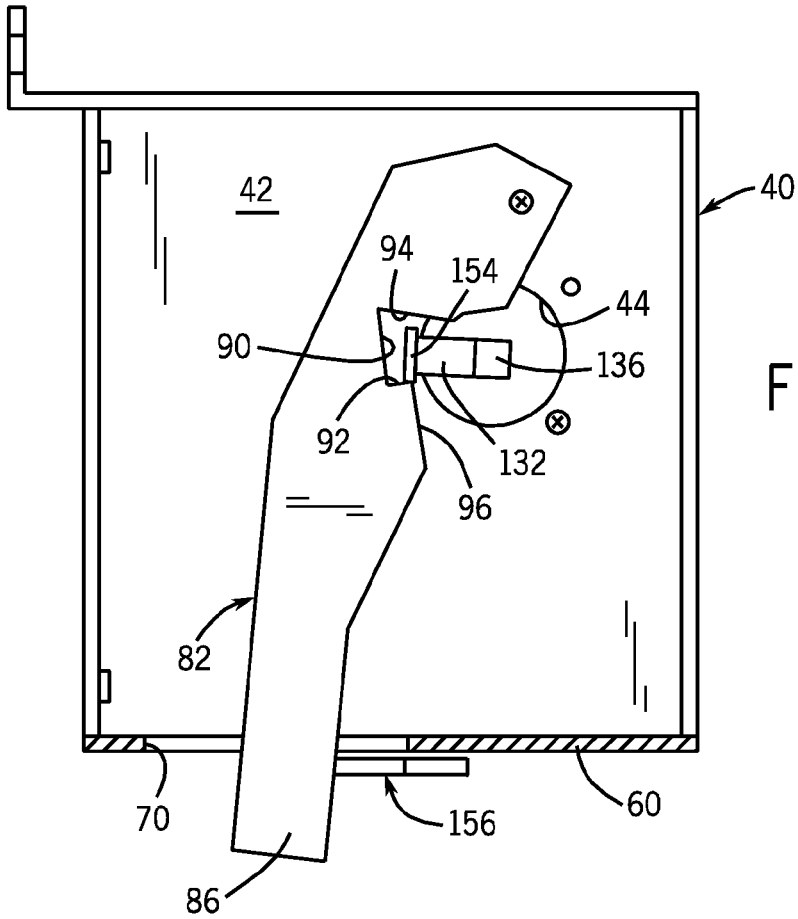
FIGS. 14A and 14B are rear cutaway and bottom plan views, respectively, of the installed door safety rotary circuit breaker interlock shown in FIG. 9, with the enclosure door in the process of being closed to cause the door hook to rotate the latch plate and with the handle still being unable to move from the OFF position to the ON position.
Figure 14B:
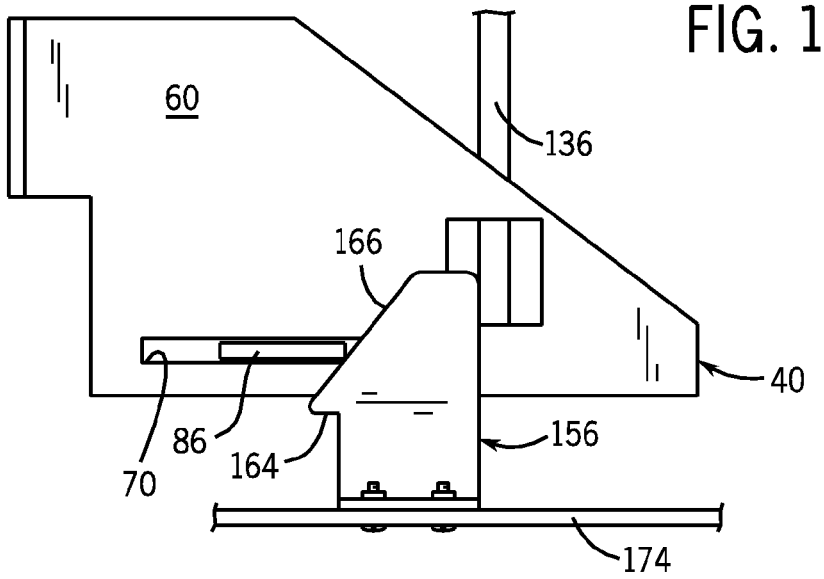

Referring now to FIGS. 14A and 14B, the enclosure door 174 is nearly (but not completely) closed, and it may be seen that the engagement area 166 of the door hook 156 has moved the distal end 86 of the latch plate 82 causing the latch plate 82 to be rotated clockwise (as viewed in FIG. 14A) to the point where the tongue 154 is nearly to the edge of the bottom lip 92 of the notch 90 of the latch plate 82. However, in this position, since the tongue 154 is still in engagement with the bottom lip 92 of the notch 90 of the latch plate 82, the actuation shaft 136 cannot be rotated counterclockwise (as shown in FIG. 14A), and thus the handle 48 (shown in FIG. 9) cannot be rotated clockwise (as viewed from the front of the enclosure 170 in FIG. 9) to the ON position. Since the enclosure door 174 has not yet been closed, it may be seen that the door safety rotary circuit breaker interlock of the present invention prevents the rotary circuit breaker 172 (shown in FIG. 9) from being turned ON.

Figure 15A:
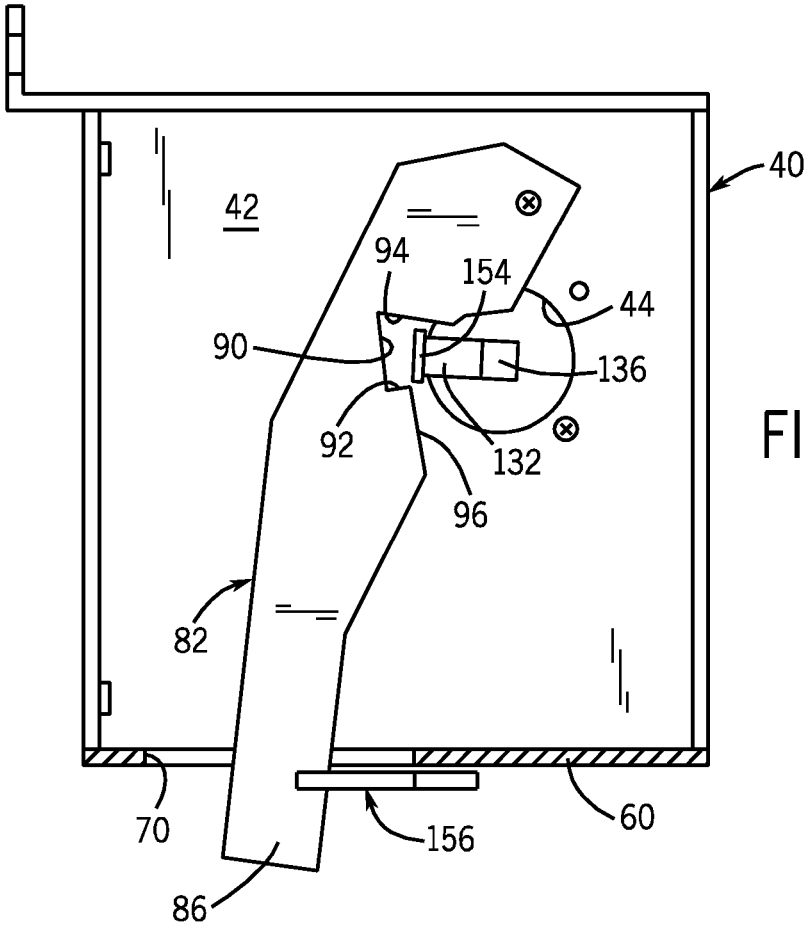
FIGS. 15A and 15B are rear cutaway and bottom plan views, respectively, of the installed door safety rotary circuit breaker interlock shown in FIG. 9, with the enclosure door fully closed and with the handle in the OFF position and able to be rotated to the ON position.
Figure 15B:
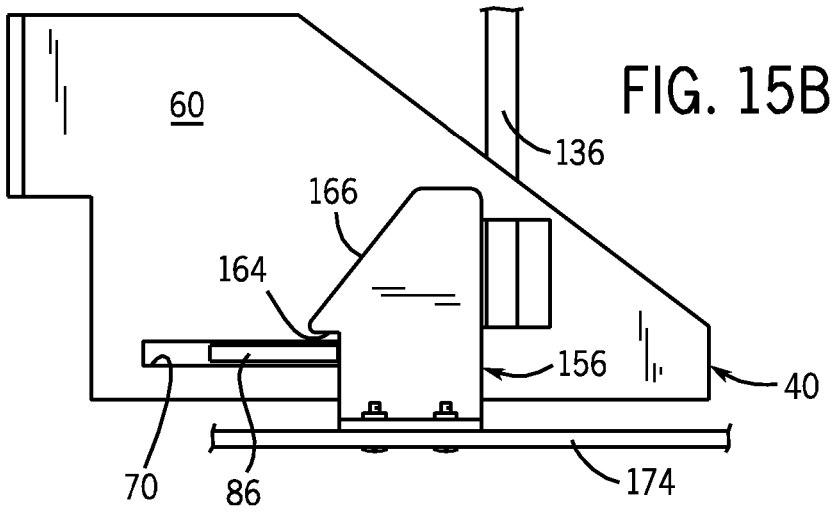

Referring next to FIGS. 15A and 15B, the enclosure door 174 has been completely closed and the engagement area 166 of the door hook 156 has moved past the distal end 86 of the latch plate 82, causing the latch plate 82 to be rotated further clockwise (as viewed in FIG. 14A) to the point where the tongue 154 has moved off of the edge of the bottom lip 92 of the latch plate 82. Thus, since the tongue 154 no longer is in contact with the bottom lip 92 of the latch plate 82, the actuation shaft 136 can now be rotated counterclockwise (as shown in FIG. 14A), and thus the handle 48 (shown in FIG. 9) can be rotated clockwise (as viewed from the front of the enclosure 170 in FIG. 9) to the ON position.

It will be appreciated by those skilled in the art that on occasions it may be desirable to allow the rotary circuit breaker 172 to be turned ON by maintenance personnel without first closing the enclosure door 174. Doing so requires moving the latch plate 82 to the position in which it is shown in FIG. 12A. When the enclosure door 174 is open, this may be done by manually moving the distal end 86 of the latch plate 82 to the right (as viewed in FIG. 9).

This is easy to do when the enclosure door 174 is open, since the distal end 86 of the latch plate 82 extends downwardly from the bottom of the mounting bracket 40 and is thus quite accessible. However, the location of the handle 48 on the mounting bracket 40 relative to the location of the distal end 86 of the latch plate 82 and the force required to rotate the handle 48 are such that it is not possible to simultaneously move the distal end 86 of the latch plate 82 and rotate the handle 48 with a single hand. This ensures that power may not be turned on by someone with one hand while the other hand is in contact with areas of hazardous voltages inside the enclosure 170.

It may also be desirable to allow a closed enclosure door 174 to be opened by maintenance personnel without the rotary circuit breaker 172 first being turned OFF. This is facilitated by the mounting hardware that is used to pivotally mount the latch plate 82 on the mounting bracket 40. By using a screwdriver (not shown) to engage the slot 118 in the rotatable member 112, the latch plate 82 can be manually rotated out of engagement with the tongue 154, thereby allowing the enclosure door 174 to be opened without first turning the rotary circuit breaker 172 being OFF, and to allow the rotary circuit breaker 172 to be turned ON without first closing the enclosure door 174. The size and shape of the flange 114 of the rotatable member 112 together with the weight of the latch plate 82 makes it impossible to rotate the flange 114 of the rotatable member 112 by hand, thereby ensuring that a screwdriver is required. This feature ensures that an intentional action with a tool is required to open the enclosure door 174 while the rotary circuit breaker 172 is ON, thereby ensuring that the enclosure door 174 cannot be opened inadvertently.

Figure 16A:
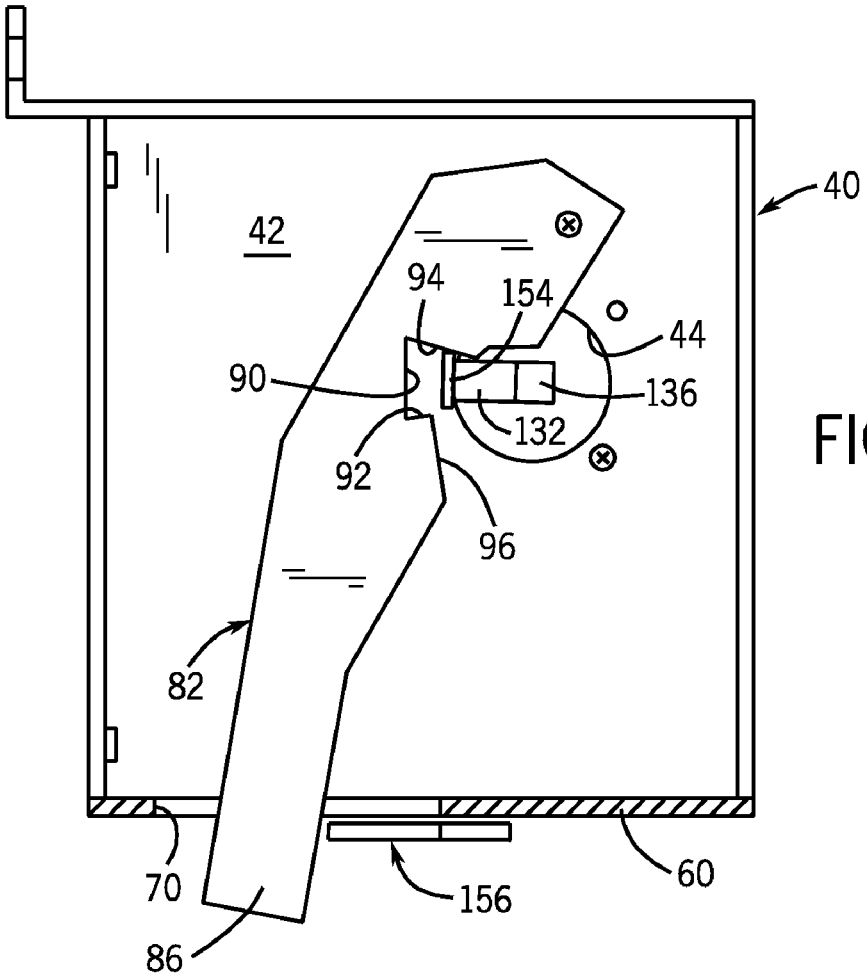
FIGS. 16A and 16B are rear cutaway and bottom plan views, respectively, of a first alternate embodiment door safety rotary circuit breaker interlock installed in an enclosure in a manner similar to that shown in FIG. 9, with the handle turned to the OFF position to unlock the enclosure door, which is still in the closed position.
Figure 16B:
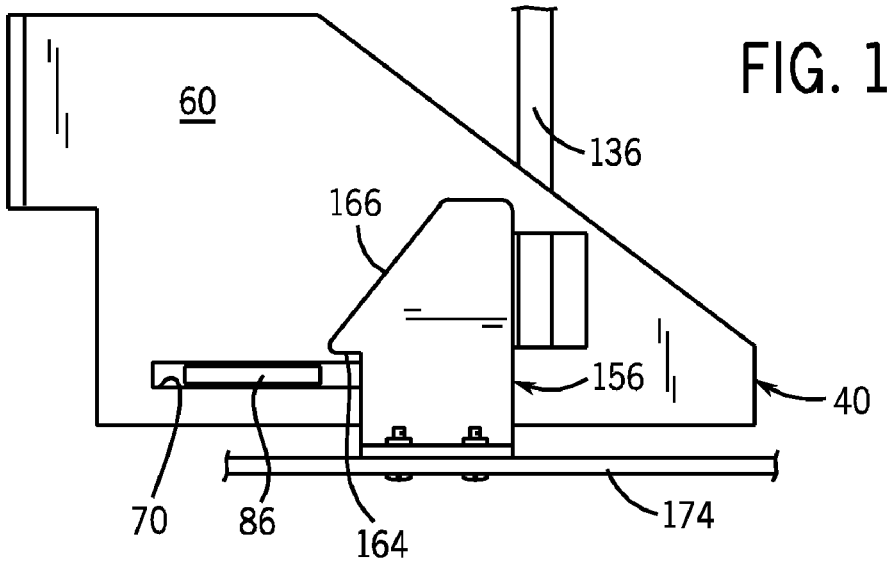

A modified version of the door safety rotary circuit breaker interlock of the present invention is shown in FIGS. 16A and 16B. FIG. 16A is from the back side of the mounting bracket 40, and FIG. 16B is from the bottom of the mounting bracket 40. The position of the notch 90 on the latch plate 82 has been moved slightly further from the pivot point. This causes the tongue 154 to engage the top lip 94 of the latch plate 82 as the handle 48 (shown in FIG. 9) is being moved from the ON position to the OFF position. The handle 48 as shown in FIGS. 11A and 11B has been turned ninety degrees counterclockwise (as viewed from the front of the enclosure the enclosure 170 in FIG. 9) from its ON position to its OFF position, causing the tongue 154 to drive the top lip 94 of the latch plate 82 upwardly, causing the latch plate 82 to rotate clockwise (as viewed in FIG. 16A). This movement of the latch plate 82 moves the distal end 86 of the latch plate 82 out of engagement with the latching area 164 of the door hook 156, thereby disengaging the door hook 156 and allowing the enclosure 170 to be opened.

This alternative embodiment may be used if the safety feature that requires a deliberate action to rotate the handle 48 past its OFF position in order to unlock the enclosure door 174 is not desired or if it is not possible due to the characteristics of the rotary circuit breaker 172 being used. Another way of achieving the same operation would be to change the mounting position of the latch plate 82 in the mounting bracket 40 to move it downwardly (as shown in FIG. 16A).

The exemplary embodiments shown in FIGS. 1 through 16 are configured to be located on the right side of the enclosure 170 and to fit to a square aperture 178 in the enclosure door 174. With only minor changes the door safety rotary circuit breaker interlock of the present invention can be adapted to fit at the side of an enclosure door (rather than within an aperture in the door), and/or to be mounted on an enclosure on the left side or above or the enclosure door. This allows the door safety rotary circuit breaker interlock of the present invention to be used with enclosures having enclosure doors that are hinged on the left, right, top, or bottom.

Figure 17:
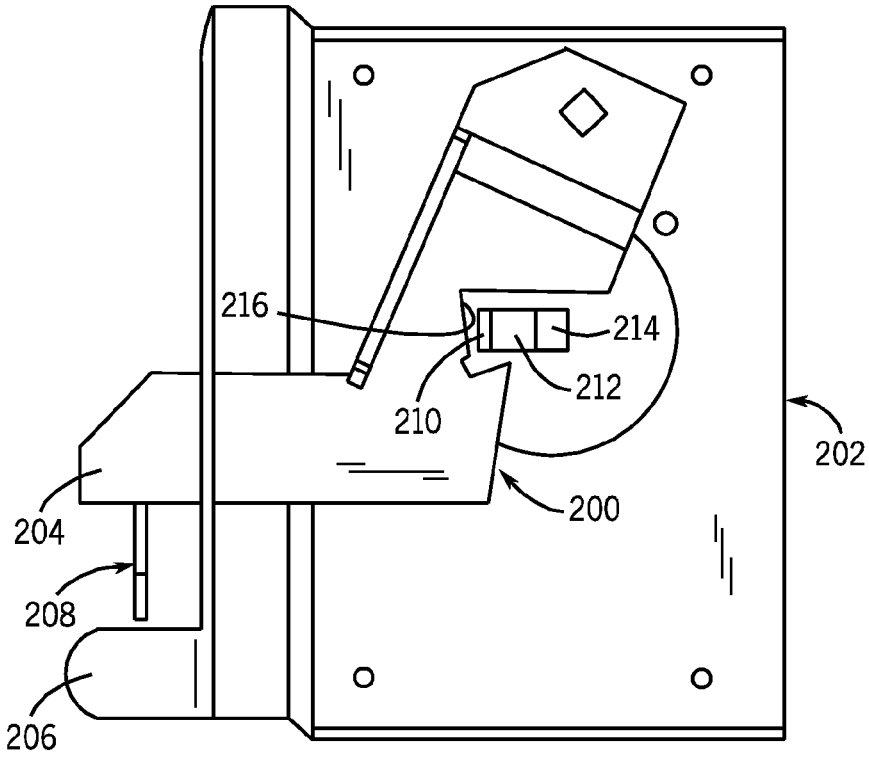
FIG. 17 is a rear plan views of a second alternate embodiment door safety rotary circuit breaker interlock having the distal end of the latch plate extending from the side for installation in a panel of an enclosure on the left side of the enclosure for use with an enclosure door hinged on the right of the enclosure.

For example, in FIG. 17, a door safety rotary circuit breaker interlock that is located within a panel on the left side of an enclosure door (not shown herein) is shown from the back side thereof. A latch plate 200 is pivotably mounted in a mounting bracket 202, with the latch plate 200 having a distal end 204 projecting from the left side of the mounting bracket 202 (as viewed in FIG. 17) off of a "knee" in the latch plate 200 that is at an approximately one hundred ten degree angle from the other end of the latch plate 200. The mounting bracket 202 also include a laterally extending support member 206 above which a door hook 208 will move as the enclosure door is opened and closed.

A tongue 210 extending from a tongue bracket 212 mounted on an actuation shaft 214 is shown in engagement with a notch 216. This is the OFF position, and the distal end 204 of the latch plate 200 is beginning to be engaged by the door hook 208 as the enclosure door is approaching its closed position. In this position, the tongue 210 is engaged by the notch 216, thereby preventing the actuation shaft 214 from being rotated in a counterclockwise direction (as shown in FIG. 17) to the ON position until the door hook 208 drives the latch plate 200 further in a clockwise direction (as shown in FIG. 17).

Figure 18:
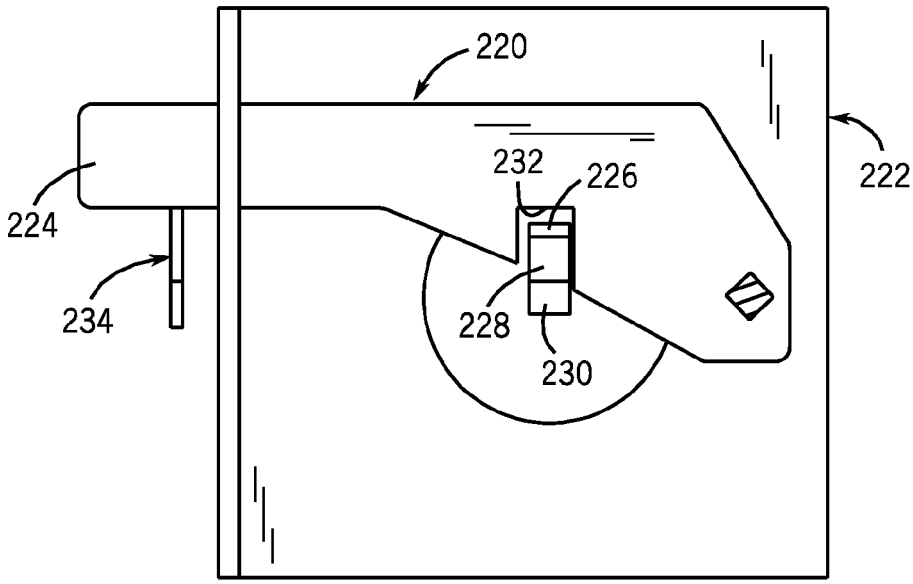
FIG. 18 is a third alternate embodiment door safety rotary circuit breaker interlock also having the distal end of the latch plate extending from the side for installation in an enclosure on the left side thereof for use with an enclosure door hinged on the right of the enclosure.
Figure 19:
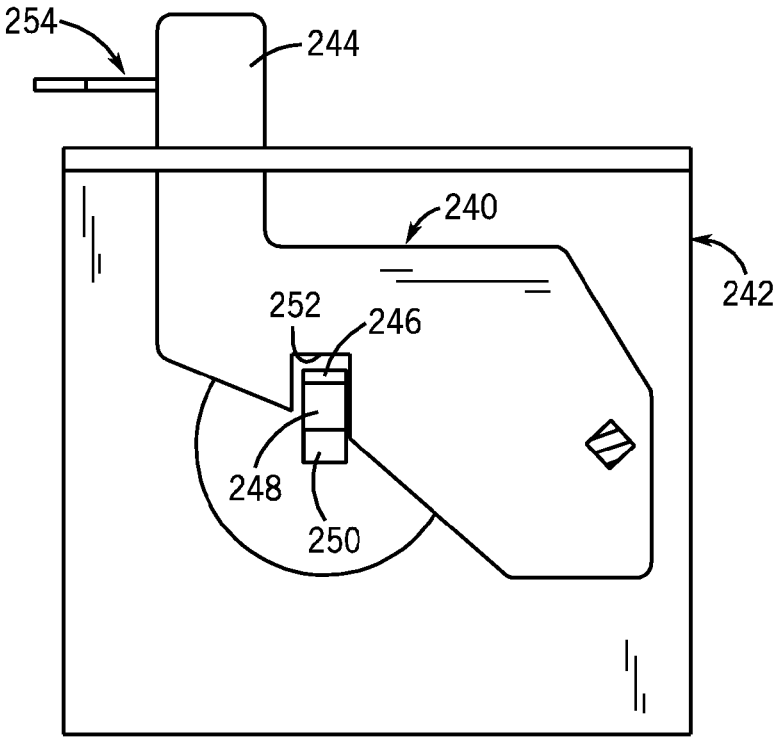
FIG. 19 is a fourth alternate embodiment door safety rotary circuit breaker interlock having the distal end of the latch plate extending from the top for installation in an enclosure having an enclosure door hinged on either the left or the right of the enclosure.
Figure 20:
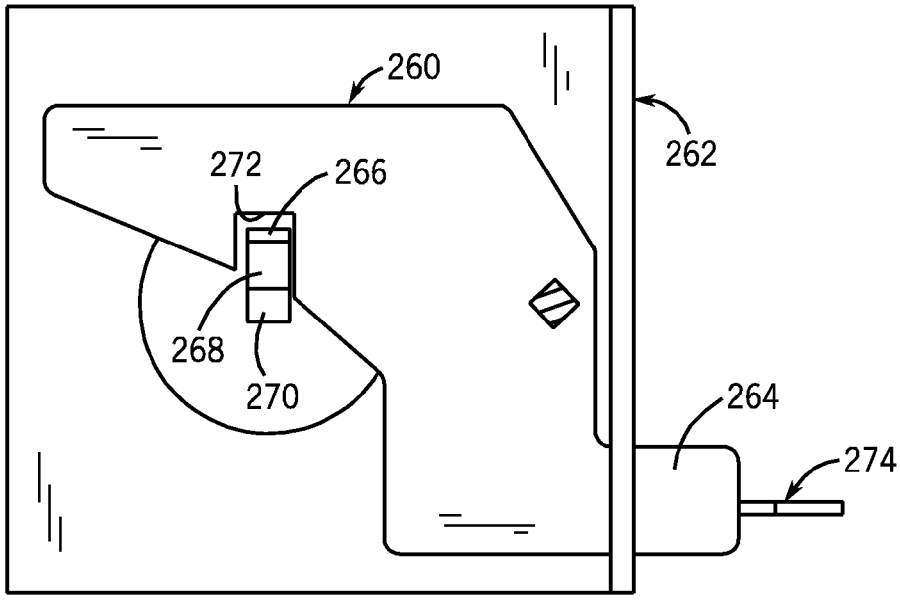
FIG. 20 is a fifth alternate embodiment door safety rotary circuit breaker interlock having the latching end of a central pivot latch plate extending from the side for installation in an enclosure on the right side thereof for use with a door hinged on the left of the enclosure.

FIGS. 18 through 20 show three additional alternate embodiments in somewhat simplified form, all shown from the back side thereof. Referring first to FIG. 18, a door safety rotary circuit breaker interlock that is located on the left side of an enclosure door (not shown herein, but hinged on the right side thereof) that will be accessible through a rectangular aperture in the enclosure door (also not shown herein) is illustrated. A latch plate 220 is pivotably mounted in a mounting bracket 222, with the latch plate 220 having a distal end 224 projecting from the left side of the mounting bracket 222 (as viewed in FIG. 18).

A tongue 226 extending from a tongue bracket 228 mounted on an actuation shaft 230 is shown in engagement with a notch 232 located on the downwardly-facing side of the latch plate 220 (as shown in FIG. 18). This is the OFF position, and the distal end 224 of the latch plate 220 is beginning to be engaged by a door hook 234 as the enclosure door is approaching its closed position. In this position, the tongue 226 is engaged by the notch 232, thereby preventing the actuation shaft 230 from being rotated in a counterclockwise direction (as shown in FIG. 18) to the ON position until the door hook 234 drives the latch plate 220 further in a clockwise direction (as shown in FIG. 18).

Referring next to FIG. 19, a door safety rotary circuit breaker interlock that is mounted on an enclosure (not shown herein) and may be used with an enclosure door (also not shown herein) that is hinged on either the right side or the left side thereof and that will be accessible through a rectangular aperture in the enclosure door is illustrated. A latch plate 240 is pivotably mounted in a mounting bracket 242, with the latch plate 240 having a distal end 244 projecting from the top side of the mounting bracket 242 (as viewed in FIG. 19) off of a right angle in the latch plate 240 from the other end of the latch plate 240.

A tongue 246 extending from a tongue bracket 248 mounted on an actuation shaft 250 is shown in engagement with a notch 252 located on the downwardly-facing side of the latch plate 240 (as shown in FIG. 19). This is the OFF position, and the distal end 244 of the latch plate 240 is beginning to be engaged by a door hook 254 as the enclosure door is approaching its closed position. In this position, the tongue 246 is engaged by the notch 252, thereby preventing the actuation shaft 250 from being rotated in a counterclockwise direction (as shown in FIG. 19) to the ON position until the door hook 254 drives the latch plate 240 further in a clockwise direction (as shown in FIG. 19).

Referring finally to FIG. 20, a door safety rotary circuit breaker interlock that is mounted on an enclosure (not shown herein) and may be used with an enclosure door (also not shown herein) that is hinged on either the right side or the left side thereof and that will be accessible through a rectangular aperture in the enclosure door is illustrated. A latch plate 260 is pivotably mounted in a mounting bracket 262, with the latch plate 260 having a distal end 264 projecting from the right side of the mounting bracket 262 (as viewed in FIG. 20) The latch plate 260 is unique in that its pivot point is located at an intermediate point rather than near an end thereof.

A tongue 266 extending from a tongue bracket 268 mounted on an actuation shaft 270 is shown in engagement with a notch 272 located on the downwardly-facing side of the end of the latch plate 260 that is opposite the distal end 264. This is the OFF position, and the distal end 264 of the latch plate 260 is beginning to be engaged by a door hook 274 as the enclosure door is approaching its closed position. In this position, the tongue 266 is engaged by the notch 272, thereby preventing the actuation shaft 270 from being rotated in a counterclockwise direction (as shown in FIG. 20) to the ON position until the door hook 274 drives the latch plate 260 further in a clockwise direction (as shown in FIG. 20).

It may therefore be appreciated from the above detailed description of the exemplary embodiments of the door safety rotary circuit breaker interlock of the present invention that it represents both a simplification to and an improvement upon other interlock devices that have been known in the past. Aside from the handle and the actuation shaft which are used to turn the rotary circuit breaker on and off and the door hook mounted on the back side of the enclosure door, the door safety rotary circuit breaker interlock of the present invention has only one moving part, namely the latch plate. No complex linkages or springs are either used or required for the door safety rotary circuit breaker interlock to operate, since gravity provides all the force that is necessary to move the latch plate from its unlocked position to its locked position.

Although the foregoing description of the door safety rotary circuit breaker interlock of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A door interlock mechanism for a circuit breaker actuated by rotation of an actuation shaft that is driven by a handle and is located in an enclosure having a hinged enclosure door, said door interlock mechanism comprising:

a housing member for installation in the enclosure, the handle being mountable on a front side of said housing member with the rotating shaft extending from a back side of said housing member to the circuit breaker;

a latch plate mounted in said housing member for pivotable movement about an axis between first and second positions, said latch plate being biased by gravity from said first position toward said second position, said latch plate having a notch located therein and a distal portion that extends from said housing member;

a tongue fixedly attachable to and rotatable with the actuating shaft, said tongue extending laterally from the actuating shaft and being located in a longitudinal location on the actuating shaft whereby said tongue may be engaged by said notch on said latch plate; and a door hook fixedly attachable to the enclosure door, said door hook being engageable by said distal portion of said latch plate to retain the enclosure door in a closed position.

2. A door interlock mechanism as defined in claim 1, wherein said latch plate is of one-piece construction.

3. A door interlock mechanism as defined in claim 1, wherein said latch plate requires no biasing mechanism other than gravity to be driven from said first position to said second position.

4. A door interlock mechanism as defined in claim 1, wherein said notch in said latch plate and said tongue are arranged and configured such that when said latch plate is in said second position, said latch plate and said tongue cooperate to prevent the handle from being rotated from an OFF position corresponding to the placement of the circuit breaker in an OFF position to an ON position corresponding to the placement of the circuit breaker in an ON position.

5. A door interlock mechanism as defined in claim 1, wherein said latch plate is located in a third position intermediate said first and second positions when the enclosure door is closed and said distal portion of said latch plate is engaging said door hook to retain the enclosure door in a closed position.

6. A door interlock mechanism as defined in claim 5, wherein said notch in said latch plate and said tongue are arranged and configured such that when the handle is in an ON position corresponding to the placement of the circuit breaker in an ON position, said tongue can not cause said latch plate to move from said third position toward said first position.

7. A door interlock mechanism as defined in claim 5, wherein when said latch plate is in said third position, the handle may be rotated between ON and OFF positions corresponding respectively to the placement of the circuit breaker in ON and OFF positions.

8. A door interlock mechanism as defined in claim 5, wherein as the enclosure door is closed, said door hook will cause said latch plate to move from said second position to a position intermediate said first and third positions, and then to said third position when the enclosure door is closed and said distal portion of said latch plate is engaging said door hook to retain the enclosure door in a closed position.

9. A door interlock mechanism as defined in claim 1, wherein when said distal portion of said latch plate is engaging said door hook to retain the enclosure door in a closed position, rotating the handle from being rotated from an ON position corresponding to the placement of the circuit breaker in an ON position to an OFF position corresponding to the placement of the circuit breaker in an OFF position causes said distal portion of said latch plate to become disengaged from said door hook, thereby allowing the enclosure door to be opened.

10. A door interlock mechanism as defined in claim 1, wherein when said distal portion of said latch plate is engaging said door hook to retain the enclosure door in a closed position, rotating the handle from being rotated from an ON position corresponding to the placement of the circuit breaker in an ON position to an OFF position corresponding to the placement of the circuit breaker in an OFF position does not cause said distal portion of said latch plate to become disengaged from said door hook.

11. A door interlock mechanism as defined in claim 10, wherein rotating the handle in a direction from the ON position to the OFF position to a position beyond the OFF position causes said distal portion of said latch plate to become disengaged from said door hook, thereby allowing the enclosure door to be opened.

12. A door interlock mechanism as defined in claim 1, additionally comprising:

a mechanism accessible from said front side of said housing member for allowing the manual movement of said latch plate to said first position irrespective of the position of the handle and whether or not the enclosure door is closed.

13. A door interlock mechanism as defined in claim 1, additionally comprising:

a supplemental biasing mechanism for biasing said latch plate from said first position toward said second position.

14. A door interlock mechanism as defined in claim 13, wherein said supplemental biasing mechanism comprises:

a spring.

15. A door interlock mechanism as defined in claim 1, wherein said front side of said housing member is arranged and configured to be received immediately behind or within an aperture located in the enclosure door when the enclosure door is in a closed position on the enclosure.

16. A door interlock mechanism as defined in claim 1, wherein said front side of said housing member is arranged and configured to be mounted inside the enclosure and adjacent a side thereof and the enclosure door is adjacent said housing member when the enclosure door is in a closed position on the enclosure.

17. A door interlock mechanism as defined in claim 1, wherein said tongue extends in a direction parallel to and is spaced away from the actuation shaft.

18. A door interlock mechanism for a circuit breaker actuated by rotation of an actuation shaft that is driven by a handle and is located in an enclosure having a hinged enclosure door, said door interlock mechanism comprising:

a housing member for installation in the enclosure, the handle being mountable on a front side of said housing member with the rotating shaft extending from a back side of said housing member to the circuit breaker;

a latch plate mounted in said housing member for pivotable movement about an axis between first and second positions, said latch plate being biased by gravity from said first position toward said second position, said latch plate having a notch located therein and a distal portion that extends from said housing member, said latch plate being of one-piece construction and requiring no biasing mechanism other than gravity to be driven from said first position to said second position;

a tongue fixedly attachable to and rotatable with the actuating shaft, said tongue extending laterally from the actuating shaft and being located in a longitudinal location on the actuating shaft whereby said tongue may be engaged by said notch on said latch plate; and a door hook fixedly attachable to the enclosure door, said door hook being engageable by said distal portion of said latch plate to retain the enclosure door in a closed position;

wherein said latch plate is located in a third position intermediate said first and second positions when the enclosure door is closed and said distal portion of said latch plate is engaging said door hook to retain the enclosure door in a closed position.

19. A door interlock mechanism for a circuit breaker actuated by rotation of an actuation shaft that is driven by a handle and is located in an enclosure having a hinged enclosure door, said door interlock mechanism comprising:

a housing member for installation in the enclosure, the handle being mountable on a front side of said housing member with the rotating shaft extending from a back side of said housing member to the circuit breaker;

a latch plate having a notch located therein and being mounted in said housing member for pivotable movement, said latch plate being biased solely by the force of gravity;

a laterally extending tongue attachable to the actuating shaft, said tongue being engageable with said notch on said latch plate; and a door hook fixedly attachable to the enclosure door, said door hook being engageable by said distal portion of said latch plate to retain the enclosure door in a closed position.

20. A method of making a door interlock mechanism for a circuit breaker that is actuated by rotation of an actuation shaft that is driven by a handle and is located in an enclosure having a hinged enclosure door, said method comprising:

providing a housing member for installation in the enclosure, the handle being mountable on a front side of said housing member with the rotating shaft extending from a back side of said housing member to the circuit breaker;

mounting a latch plate in said housing member for pivotable movement about an axis between first and second positions, said latch plate being biased by gravity from said first position toward said second position, said latch plate having a notch located therein and a distal portion that extends from said housing member;

fixedly attaching a tongue to the actuating shaft in a manner whereby said tongue is rotatable with the actuating shaft, said tongue extending laterally from the actuating shaft and being located in a longitudinal location on the actuating shaft whereby said tongue may be engaged by said notch on said latch plate; and Providing a door hook that is fixedly attachable to the enclosure door, said door hook being engageable by said distal portion of said latch plate to retain the enclosure door in a closed position.

* * * * *